US006231359B1

(12) United States Patent
Inaba et al.

(10) Patent No.: US 6,231,359 B1
(45) Date of Patent: May 15, 2001

(54) ELECTRICAL CONNECTOR CAPABLE OF GENERATING REPELLING AND DRAWING FORCES BETWEEN PARTS

(75) Inventors: Shigemitsu Inaba; Toshiharu Kudo; Satoru Kaneko, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/369,277

(22) Filed: Aug. 6, 1999

(30) Foreign Application Priority Data

Aug. 10, 1998 (JP) ..... 10-225870

(51) Int. Cl.[7] ..... H01R 13/62
(52) U.S. Cl. ..... 439/157; 439/372
(58) Field of Search ..... 439/157, 152, 439/372, 352

(56) References Cited

U.S. PATENT DOCUMENTS 5,545,047 * 8/1996 Okada et al. ..... 439/157
5,569,041 * 10/1996 Sonobe et al. ..... 439/157
5,820,399 10/1998 Shirouzu et al. ..... 439/352

FOREIGN PATENT DOCUMENTS 10-50408 2/1998 (JP) .

* cited by examiner

*Primary Examiner*—Khiem Nguyen
*Assistant Examiner*—Son V. Nguyen
(74) *Attorney, Agent, or Firm*—Armstrong, Westerman, Hattori, McLeland & Naughton, LLP

(57) ABSTRACT

An electrical connector assembly consists of a first connector having a driven member rotatably supported thereon and a resilient member provided between the first connector and the driven member; and a second connector having a drive means which engages with and drives the driven member into rotation to bias the resilient member, wherein the resilient member, when biased, produces a repulsion force and a drawing force in order, the repulsion force and the drawing force acting through the driven member on the second connector in directions of repelling and drawing the second connector, respectively. A reliable coupling with a low force and an improved working efficiency are attained.

14 Claims, 22 Drawing Sheets

FIG. 51 20/22
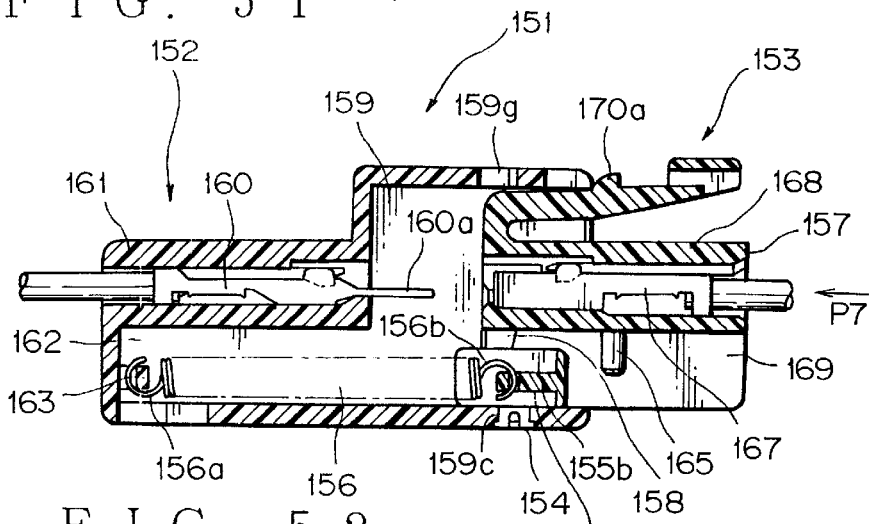
FIG. 52
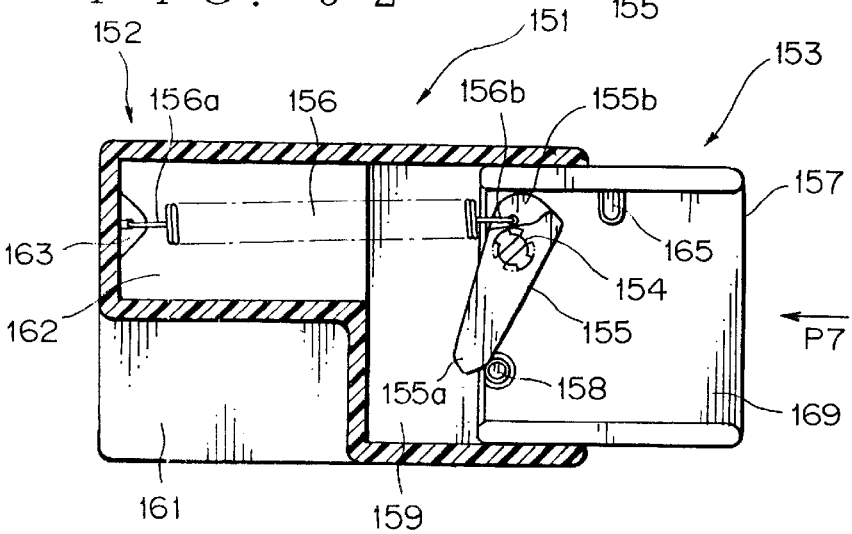
FIG. 53
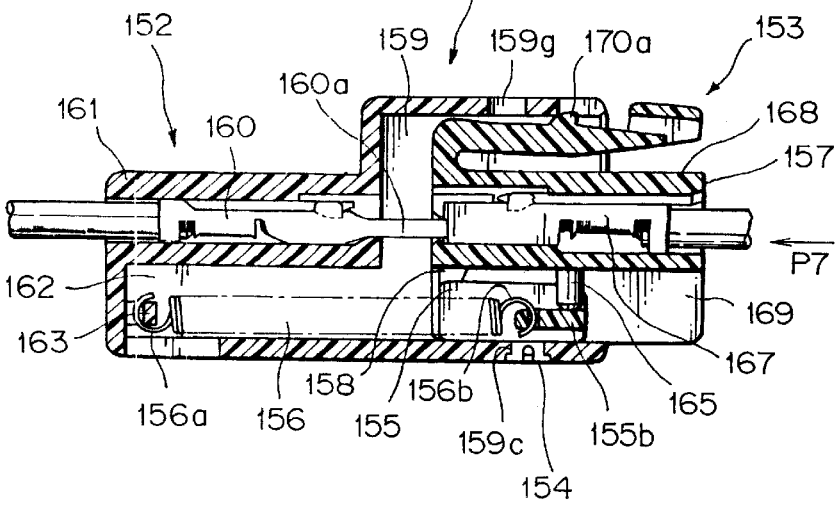

ELECTRICAL CONNECTOR CAPABLE OF GENERATING REPELLING AND DRAWING FORCES BETWEEN PARTS

BACKGROUND OF THE INVENTION

1. Field of the Invention

This invention relates to an electrical connector assembly, and more particularly to a pair of connectors reliably coupleable with each other by means of a resilient member provided on one of the connectors, and the resilient member being operable for repelling and drawing the other connector in the course of coupling the connectors.

2. Description of the Related Art

On a vehicle, such as an automobile, there are installed many electronic components for control purposes which are electrically connected by means of wiring harnesses, flat cables, and the like. These wiring harnesses, and the like, are used with various kinds of connectors which have waterproofness to be usable under severe conditions, such as submergence, and which are designed to be easily fitted and detached, making allowance for the assembly and maintenance of the vehicle.

Such a conventional pair of connectors, one provided on the electronic component and the other on the wiring harness, or the like, however, are often coupled in an incompletely-fitted condition, with terminals inside maintained out of contact with each other, though not noticeable from outside. If assembly, testing and maintenance operations are effected with such an incomplete connection overlooked, a failure of performance of such electronic equipment may be caused.

As a countermeasure to the above, connectors with an incomplete fitting detection mechanism have been proposed, in which mechanism a spring is contained in one of the mating connectors, and by making use of the repulsion force of the spring, the other connector is pushed out in case of incomplete fitting.

With the incomplete fitting detection mechanism as mentioned above, however, in order to push out the other connector, a spring is selected as that contained in the one connector which has a larger repulsion force than a terminal insertion or drawing-out force. As a result, the connector insertion force required in coupling the connectors often becomes twice or more the terminal insertion or drawing-out force, resulting in a poor working efficiency.

Further, because of the large connector insertion force required, the incomplete fitting detection mechanism is not suited for use with a multipolar connector involving many terminals.

Thus, there still remains improvement to be made to prevent an incomplete coupling of connectors and to reliably and easily couple connectors including multipolar connectors.

SUMMARY OF THE INVENTION

This invention has been accomplished to overcome the above drawbacks and an object of this invention is to provide a connector assembly in which a pair of connectors are reliably coupled with an improved working efficiency by the structure that a repulsion force is produced when the connectors are in an incomplete fitted condition, which repulsion force repels the connectors from each other so as to prevent an incomplete coupling, and a drawing force is produced at a later stage of the fitting which draws the connectors to each other in the direction of their complete coupling.

In order to attain the object, according to this invention, there is provided an electrical connector assembly which comprises: a first connector including a driven member rotatably supported thereon and a resilient member provided between the first connector and the driven member; and a second connector including a drive means which, during fitting the first and second connectors, engages with and drives the driven member into rotation to bias the resilient member, wherein the resilient member, when biased, produces a repulsion force and a succeeding drawing force, the repulsion force and the drawing force acting through the driven member on the second connector in directions of repelling and drawing the second connector, respectively.

Preferably, the driven member has a slide guide means, and the resilient member is at a first end supported on the first connector and at a second end engaged with the slide guide means to be slidable between one and the other ends of the slide guide means to cause a switch from the repulsion force to the drawing force.

Preferably, the slide guide means comprises a straight slide slit.

Preferably, the slide guide means comprises a slide slit bent at an intermediate portion thereof into two straight portions, both inclined toward a side opposite the second connector.

Preferably, the driven member has a cutout for sliding engagement therein of the drive means, and the repulsion force and the drawing force, when the drive means is engaged in the cutout, act through the driven member on the drive means and thus the second connector.

Preferably, the resilient member comprises a tension spring.

Advantageously, the second connector further includes an urged means, and the drive means and the urged means, during fitting the first and second connectors, come into engagement in succession with a first end and a second end of the driven member, respectively, and while the drive means engages with the first end of the driven member, the driven member is rotated in a direction to bias the resilient member and produce the repulsion force which acts through the first end of the driven member on the drive means in the direction of repelling the second connector and, when the drive means disengages from the first end of the driven member, the driven member is rotated in a reverse direction by a resilient force of the resilient member to produce the drawing force and the urged means engages with the second end of the driven member such that the drawing force acts on the urged means in the direction of drawing the second connector.

Preferably, the drive means and the urged means are disposed on opposite sides of an axis of the second connector, the drive means being at a position closer to the first connector than the urged means.

Advantageously, the resilient member is a compression spring and is disposed between the first connector and the driven member at the first end side where the drive means engages.

Preferably, the compression spring is at one end thereof directly supported on the driven member at the first end side.

Preferably, the compression spring is at one end supported through a support on the first connector and at the other end operably engageable with the driven member at the first end side through a closed end indirect member fitted over the compression spring, the indirect member being longitudinally slidable in the support.

Preferably, the compression spring is internally supported by a collapse-preventing pin-like element around which the compression spring is retained.

Advantageously, the resilient member is a tension spring and disposed between the first connector and the driven member at the second end side where the urged means engages.

Preferably, the driven member is rotatable about a shaft provided on the first connector, which shaft is provided with a rotation regulating means for restricting a rotational position of the driven member at least prior to fitting the first and second connectors.

Advantageously, the first and second connectors, after completion of coupling, are decoupleable in reverse order, if desired for maintenance purposes, or the like, with the drawing force first acting through the driven member on the second connector and the repulsion force then acting through the driven member on the second connector during detaching the first and second connectors.

The above and other objects, features and advantages of this invention will become apparent from the following description and the appended claims, taken in conjunction with the accompanying drawings.

BRIEF DESCRIPTION OF THE DRAWINGS

FIG. 51 is an essential portion vertical section of the connectors, shown in a halfway fitted condition;

FIG. 52 is a horizontal section of the essential portions in FIG. 51;

FIG. 53 is an essential portion vertical section of the connectors, shown in a condition further proceeded from the condition of FIG. 51;

DESCRIPTION OF THE PREFERRED EMBODIMENTS

Embodiments of this invention will now be described with reference to the attached drawings.

Figure 1:
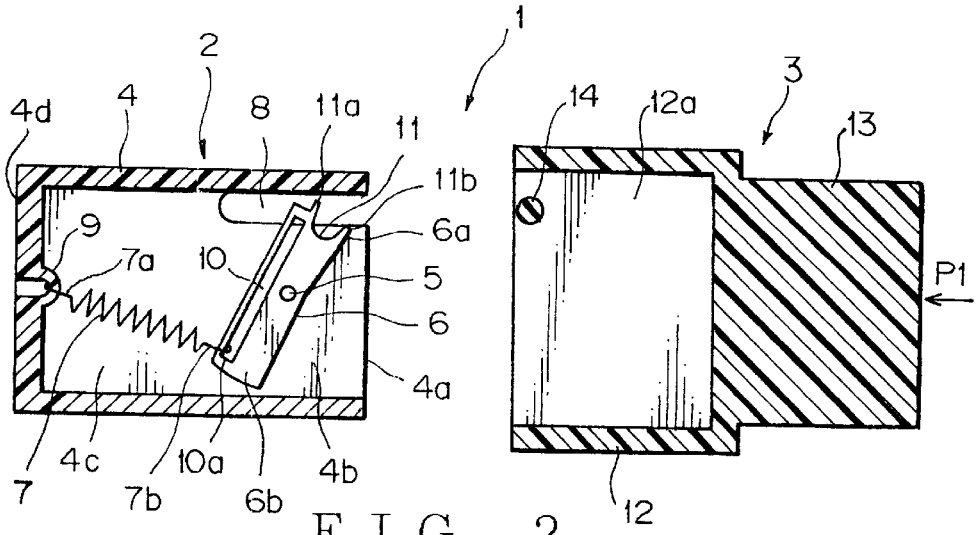
FIG. 1 is a first conceptual view for first and second embodiments of a connector assembly according to this invention, showing in vertical section essential portions of the connectors at the start of their coupling.
Figure 2:
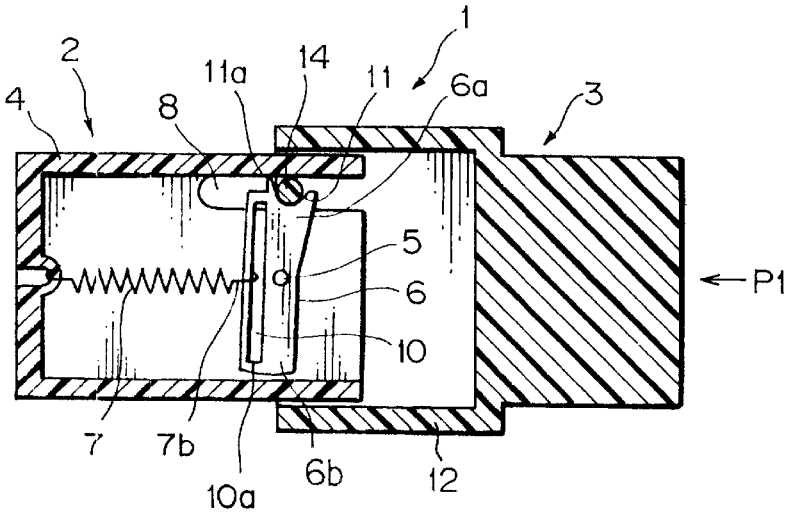
FIG. 2 is an essential portion vertical section of the connectors of FIG. 1, shown in a halfway fitted condition.
Figure 3:
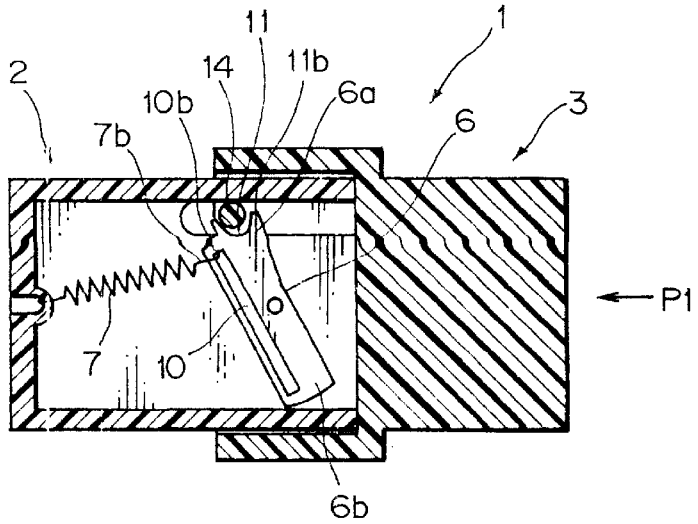
FIG. 3 is an essential portion vertical section of the connectors of FIG. 1, shown in a full fitted condition.

FIGS. 1 to 3 are first conceptual views for the first and second embodiments of a connector assembly according to this invention. The first and second embodiments of this invention will be later described with reference to FIGS. 4 to 14 and FIGS. 15 to 24, respectively. First, the first concept will be described.

FIG. 1 is a vertical section of essential portions of connectors according to this invention, FIG. 2 is an essential portion vertical section of the connectors in a halfway fitted condition, and FIG. 3 is an essential portion vertical section of the connectors fully coupled.

In FIG. 1, denoted 1 is a connector assembly made up of a male connector 2 and a female connector 3 fittable to each other. For simplicity of description, female and male wired terminals of known structure, which are received in the respective male and female connectors 2, 3, a known locking mechanism, and the like, for these connectors are omitted.

The male connector 2 includes a housing 4 of synthetic resin with an empty space 4*b* formed therein, the empty space opening at the front end 4*a* of the housing on a fitting side with the female connector 3, a driven member 6 rotatable about a shaft 5 provided on an inner side wall 4*c* of the housing 4, and a spring 7 provided between the housing 4 and the driven member 6. The side wall 4*c* is formed with a slit 8 extending inwardly from the front end 4*a*. The housing 4 is provided on the inner rear wall 4*d* with an inwardly projected U-shaped support 9 for the spring 7.

The driven member 6 takes the form of a rectangular flat plate and is rotatably supported at an intermediate portion thereof on the shaft 5. The driven member 6 has a slide slit 10 extending along one side edge between one end 6*a* and the other end 6*b* thereof. A U-shaped cutout 11 is formed at the one end 6*a* of the driven member 6.

The spring 7, a known tension spring, is at one end 7*a* supported in a hooked manner on the support 9 and, at the other end 7*b*, slidably supported in a hooked manner in the slide slit 10.

The spring 7 is normally stretched to some extent to pull, as shown in FIG. 1, at one end 10*a* of the slide slit 10 located on the other end 6*b* side of the driven member 6 so that the driven member 6 has its one end 6*a* inclined on the female connector 3 side, and that one wall 11*a* of its cutout 11 is located in the slit 8 and the other end 11*b* outside the slit 8.

The shaft 5 is provided with not-shown rotation regulating means for restricting the rotation of the driven member 6.

The female connector 3 includes a housing 13 of synthetic resin with a hollow receiving section 12 formed therein for receiving the male connector 2 and a drive portion 14 projecting on an inner wall 12*a* of the receiving section 12, the drive portion 14 being capable of sliding in the slit 8 into and out of the cutout 11 when fitting the connectors 2 and 3.

The coupling operation of the above connectors 2 and 3 will now be described with reference to FIGS. 1 to 3.

As shown in FIG. 1, the male connector 2 and the female connector 3 are arranged with their front end 4*a* and receiving section 12 opposed, followed by moving the female connector 3 in the direction of an arrow P1 to start the coupling.

As shown in FIG. 2, as the male connector 2 is received into the receiving section 12 of the female connector 3, the female connector drive portion 14 slides in the slit 8 and comes into abutment against the one wall 11*a* of the cutout 11. As the female connector 3 is further pushed, the drive portion 14 engages in the cutout 11 and presses on the one wall 11*a* to rotate the driven member 6 counterclockwise on the drawing, stretching the spring 7, at which time addition is made to the pulling force of the spring 7, with the result that the other end 7*b* of the spring 7 slides in the slide slit 10 so as to escape the added pulling force.

During when the other end 7*b* of the spring 7 is located between the end 10*a* of the slide slit 10 (FIG. 1) and a position near the shaft 5 (FIG. 2), the added pulling force of the spring 7 acts on the driven member 6 in the direction of its clockwise rotation, with the result that a repulsion force is produced at the one end 6*a* side of the driven member 6 which tends to push the female connector 3 outwardly.

Thus, in the halfway fitted condition, as shown in FIG. 2, the repulsion force produced at the one end 6*a* side of the driven member 6 acts on the drive rod 14 to push out the female connector 3, thereby to prevent an incomplete coupling.

If the female connector 3 is further pushed in the direction of the arrow P1, the other end 7*b* of the spring 7 slides rapidly to the end 10*b* of the slide slit 10, and the connectors 2 and 3 are placed in a full fitted condition.

At this time, the spring 7, due to its restoring nature, pulls at the one end 6*a* side of the driven member 6, causing a drawing force which acts through the cutout 11 on the drive portion 14 in the direction of drawing the female connector 3. A reduction is thus made in the force required for the fitting operation and a so-called low coupling force connector assembly is attained, leading to an improved working efficiency.

To decouple the connectors 2, 3, the above operation is reversed, and on moving the female connector 3 in the direction opposite the arrow P1 in FIG. 3, the drive portion 14 presses on the other wall 11*b* of the cutout 11 to rotate the driven member 6 clockwise, at which time the spring 7 is stretched to pull the driven member 6 with an increased pulling force.

As the female connector 3 is further moved in the direction opposite the arrow P1 to rotate the driven member 6 clockwise, the other end 7*b* of the spring 7 slides in the slide slit 10 to the position shown in FIG. 2 in the same manner as described above so as to escape the increased pulling force of the spring 7. On further moving the female connector 3 in the direction opposite the arrow P1, the other end 7*b* of the spring 7 slides rapidly in the slide slit 10 to its end 10*a*, as shown in FIG. 1. At this time, the spring 7, due to its restoring nature, pulls at the other end 6*b* side of the driven member 6, which in turn causes a repulsion force at the one end 6*a* side of the driven member 6 which acts through the cutout 11 on the drive portion 14 in the direction of pushing out the female connector 3. Thus, the female connector 3 can be detached with a low force.

Thus, as described above with reference to FIGS. 1 to 3, by the other end 7*b* of the spring 7 which slides between the opposite ends 10*a*, 10*b* of the slide slit 10, the repulsion force and the drawing force for the female connector 3 can be switched during the process of rotation of the driven member 6. Thus, in a halfway fitted condition, the repulsion force is produced which tends to push out the female connector 3 to thereby prevent an incomplete coupling, and subsequently, as the coupling proceeds, the drawing force is produced with which the connectors 2, 3 are drawn together, leading to a reliable coupling and an improved working efficiency.

A first embodiment of a connector assembly according to this invention will now be described with reference to FIGS. 4 to 14.

Figure 4:
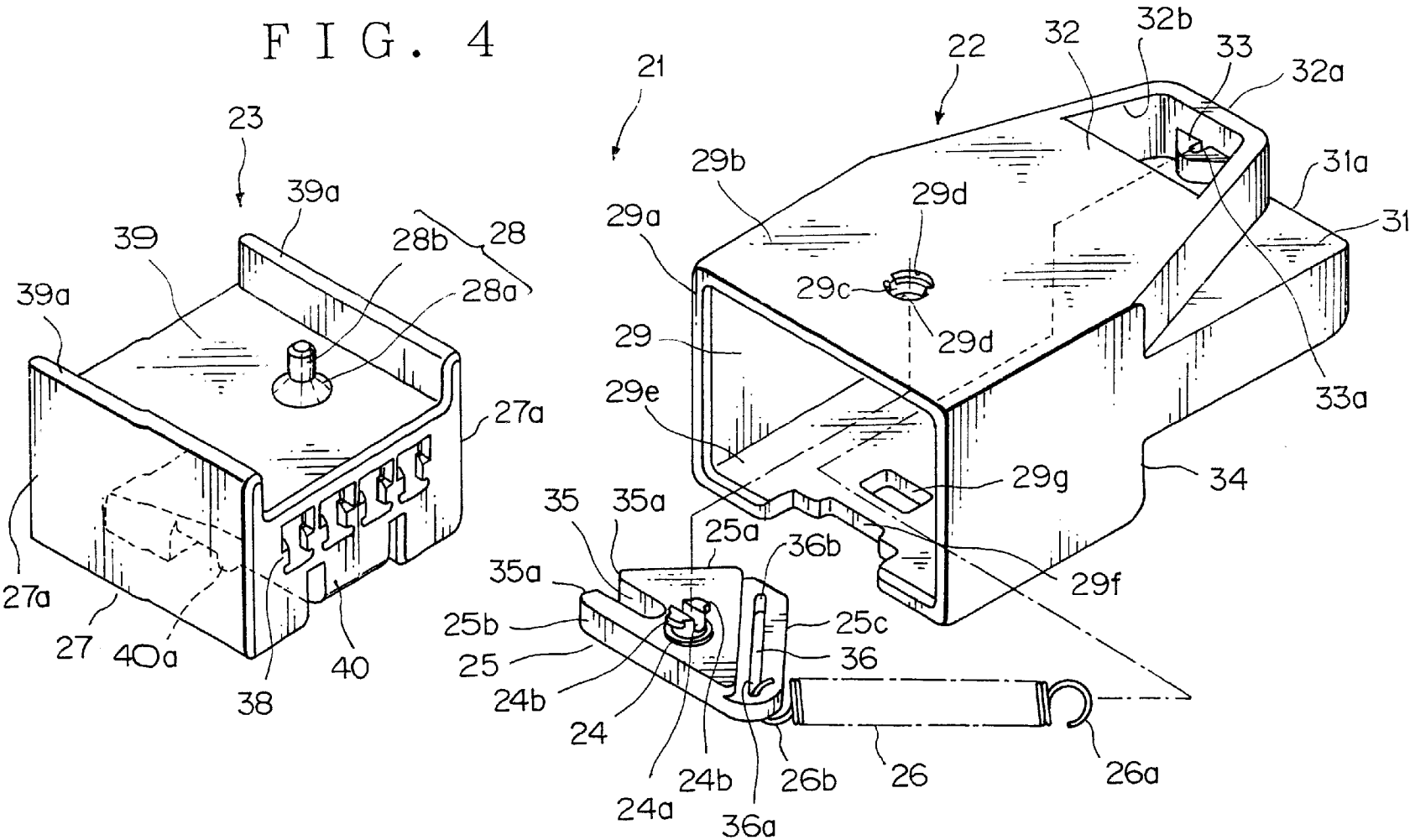
FIG. 4 is an exploded perspective view of a first embodiment of a connector assembly according to this invention.
Figure 5:
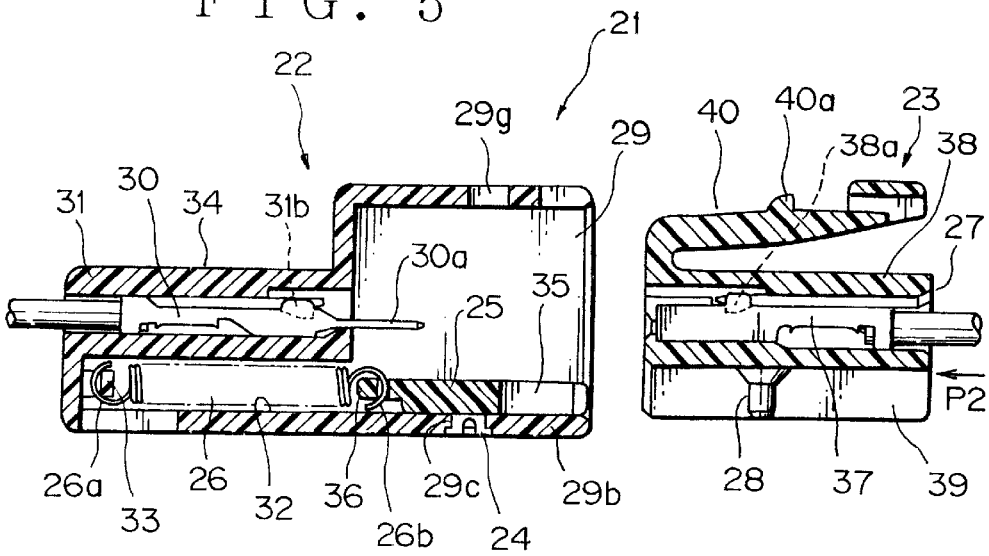
FIG. 5 is an essential portion vertical section of the connectors of the connector assembly of FIG. 4.
Figure 6:
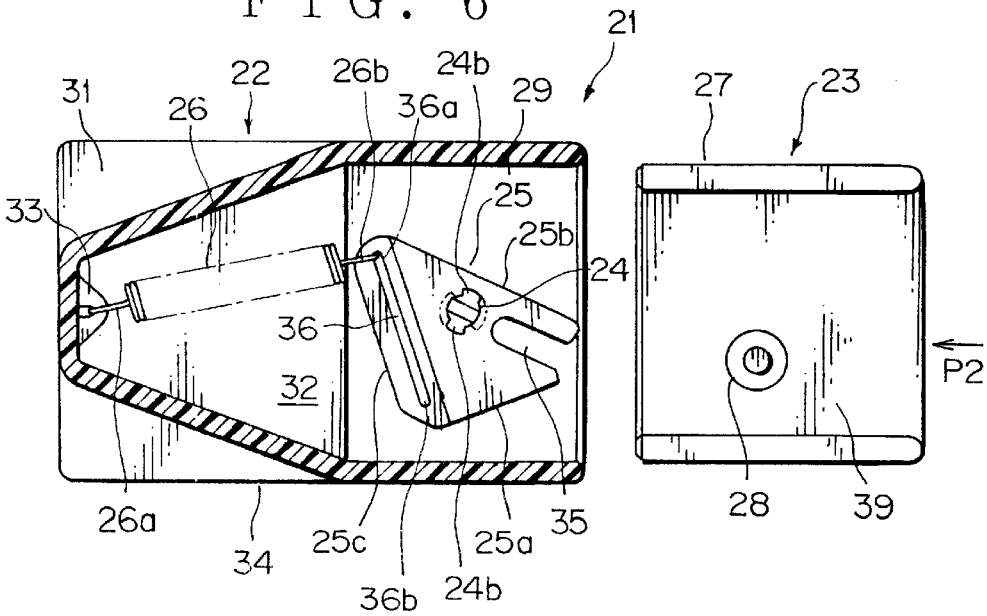
FIG. 6 is a horizontal section of the essential portions in FIG. 5.

FIG. 4 is an exploded perspective view of the connector assembly according to the first embodiment, with the connector assembly shown upside down for convenience of explanation, FIG. 5 is a vertical section of an essential portion the connector assembly of FIG. 4, and FIG. 6 is a horizontal section of an essential portion of the connector assembly of FIG. 5.

In FIG. 4, denoted as 21 is a connector assembly which is made up of a female connector 22 and a male connector 23 fittable to each other. The female connector 22 includes a driven member 25 with a shaft 24 and a tension spring 26. The male connector 23 has a drive portion 28 formed on its housing 27.

The female connector 22 has a rectangular receiving section 29 formed therein which opens at the front end 29*a* for receiving the housing 27 of the male connector 23, and a terminal accommodating section 31 with a row of known male terminals 30 accommodated therein (only one is shown in FIG. 5), the terminal accommodating section 31 adjoining the receiving section 29 at the rear end.

The female connector 22 internally has an empty space 32 in communication with the receiving section 29, which empty space is defined below the terminal accommodating section 31 (FIG. 5), and a triangular-shaped support 33 provided integrally on an part of inner rear wall 32*a* of the empty space 32.

A shaft hole 29*c* for the shaft 24 is provided in one wall 29*b* of the receiving section 29, the shaft hole having a pair of recesses 29*d*, 29*d* formed at its circumferential edge which cooperate with a later-described pair of rotation regulating projections 24*b*, 24*b* of the shaft 24 to regulate the rotation of the driven member 25. The wall 29*e* opposed to the one wall 29*b* has a recess 29*f* extending inwardly from the front end 29*a* in a stepped manner (FIG. 4) and a rectangular locking hole 29*g* formed therethrough on an inboard side of the stepped recess 29*f*.

The support 33 is provided with a throughhole 33*a* to which the spring 26 is at one end 26*a* anchored. Denoted 32*b* is a work window for use in mounting the spring 26.

The driven member 25, constituted by a triangular-shaped plate of synthetic resin, has, in addition to the shaft 24, a cutout 35 and a slide slit 36, the shaft 24 being fittable into the shaft hole 29*c* to rotatably support the driven member 25 inside the receiving section 29.

The shaft 24 is of circular cross section and has a vertical slit 24*a* extending from the top end toward the driven member 25. The pair of rotation regulating projections 24*b*, 24*b* are provided on opposite sides of the slit at the top end of the shaft 24.

The cutout 35 is of U-shape and provided at the entrance with tapers 35*a*, 35*a* and extends from a first side edge 25*a* of the driven member 25 in parallel to a second side edge 25*b* of same. The slide slit 36 has one end 36*a* and the other end 36*b*, extends along a third side edge 25*c* of the driven member 25 and has a small width as compared with the cutout 35.

The shaft 24 is located on the axis (not shown) of the cutout 35. That part of the driven member 25 including the slide slit 36 is formed at a one-step lower level in thickness direction than the remainder of the driven member 25 for hooking engagement of the other end 26*b* of the spring 26 in the slide slit 36.

The male connector 23 includes a housing 27 of substantially rectangular shape with a rectangular-shaped terminal accommodating section 38 formed therein for receiving a row of known female terminals 37 (only one is shown in FIG. 5). The housing 27 has a drive portion-containing space section 39 formed at one vertical side of the terminal accommodating section 38, the drive portion-containing space section containing the drive portion 28. At the other vertical side of the terminal accommodating section 38 is pro vided a locking arm 40.

The drive portion-containing space section 39 is laterally defined by side walls 39*a*, 39*a* of the housing 27, and the drive portion 28 is located therein at such position as will enter the cutout 35 when coupling the connectors 22, 23.

The drive portion 28 consists of a ring-shaped seat 28*a* and a pin 28*b* of substantially circular cross section errected on the seat 28*a*.

The locking arm 40 is of known structure and is provided with a locking projection 40*a* for locking engagement in the locking hole 29*g*.

The assemblage of the female and male connectors 22 and 23 will now be described with reference to FIGS. 5 and 6.

First, description is made of the female connector 22.

As shown in FIG. 5, the terminal receiving section 31 has wired male terminals 30 locked therein with related lances 31*b*. The electrical contact 30*a* of each male terminal 30 is located protruding into the receiving section 29.

The driven member 25 is mounted on the inner side of the one wall 29*b* of the receiving section 29, with its shaft 24 fitted in the shaft hole 29*c*. The spring 26, one end 26*a* thereof attached to the support 33, is at the other end 26*b* slidably engaged in the slide slit 36 at the one end 36*a*. The spring 26 is normally stretched to some extent to pull at the one end 36*a* of the slide slit 36.

The shaft 24 and the support 33, as indicated in FIG. 6, are located on the same axis (not shown) of the female connector 22. The driven member 25 has its cutout 35 located on a side closer to the male connector 23. Thus, the driven member 25 is disposed so that its first to third side edges 25*a* to 25*c* are inclined relative to the not-shown axis of the female connector 22. Due to the rotation regulating projections 24*b*, 24*b* which restrict the rotation of the driven member 25, the spring 26 is disposed inclinedly to the not-shown axis of the female connector 22, as shown in FIG. 6.

Description will now be made of the male connector 23.

As shown in FIG. 5, the terminal accommodating section 38 has wired female terminals 37 locked therein with related lances 38*a*.

The drive portion 28 is located at an offset position from the axis (not shown) of the male terminal 23, as shown in FIG. 6, so as to enter the cutout 35 as mentioned above.

The coupling operation of the female and male connectors 22 and 23 will now be described with reference to FIGS. 5 to 14, each two of which, for example, FIGS. 5 and 6, FIGS. 7 and 8, . . . are paired, odd figures being longitudinal sections and even figures being horizontal sections showing essential portions in the related odd figures.

The female connector 22 and the male connector 23 are arranged in opposed relation to be coupled, as shown in FIGS. 5 and 6, followed by moving the male connector 23 in the direction of an arrow P2 to start the coupling.

Figure 7:
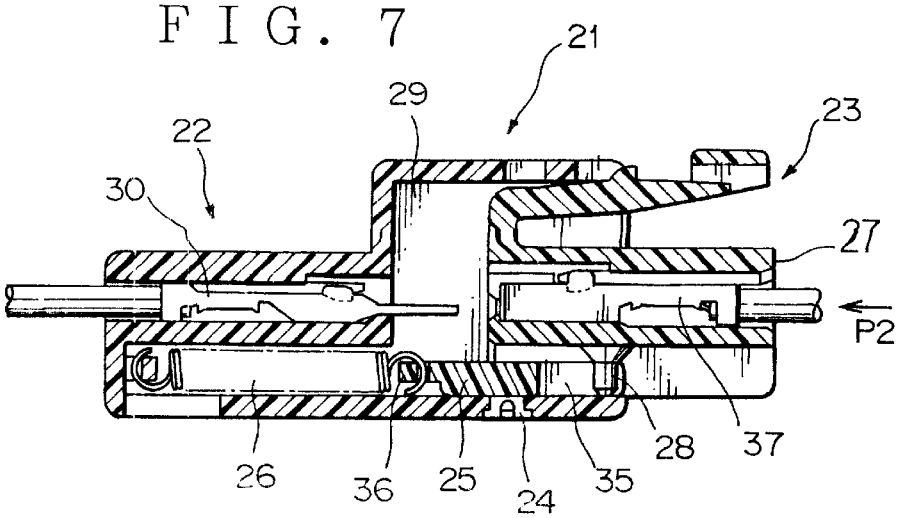
FIG. 7 is an essential portion vertical section of the connectors of FIG. 5, shown in a halfway fitted condition.
Figure 8:
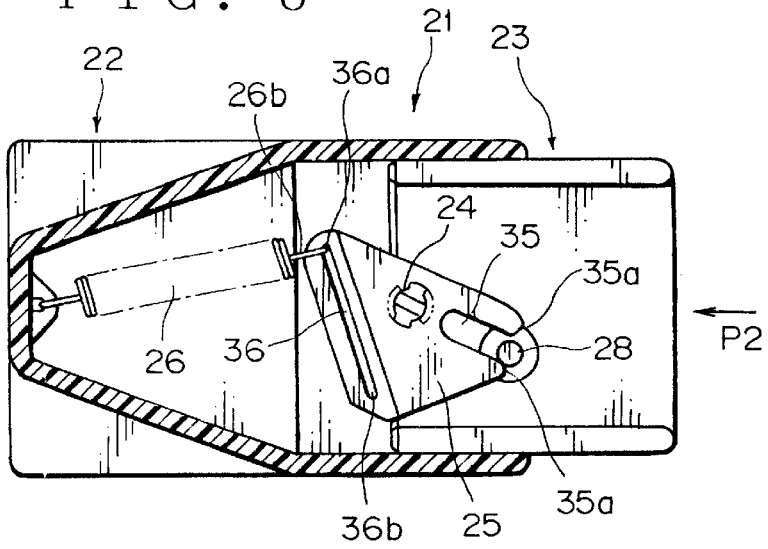
FIG. 8 is a horizontal section of the essential portions in FIG. 7.

If the male connector 23 advances halfway into the receiving section 29 of the female connector 22, as shown in FIGS. 7 and 8, the male connector drive portion 28 arrives at the tapers 35*a*, 35*a* at the entrance of the cutout 35 (FIG. 8), at which time the male and female terminals 30 and 37 are still not in contact with each other (FIG. 7).

On further pushing the male connector 23 in the direction of the arrow P2, the male connector drive portion 28 engages and slides in the cutout 35, while causing a clockwise rotation of the driven member 25 as illustrated in the drawing. The spring 26 is stretched in compliance therewith, with the result that an addition is made to its pulling force.

Figure 9:
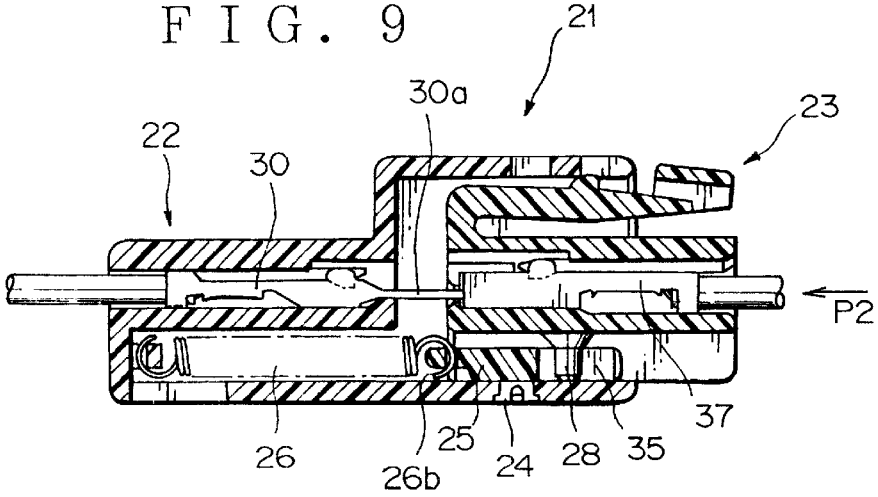
FIG. 9 is an essential portion vertical section of the connectors, shown in a condition proceeded from the condition of FIG. 7.
Figure 10:
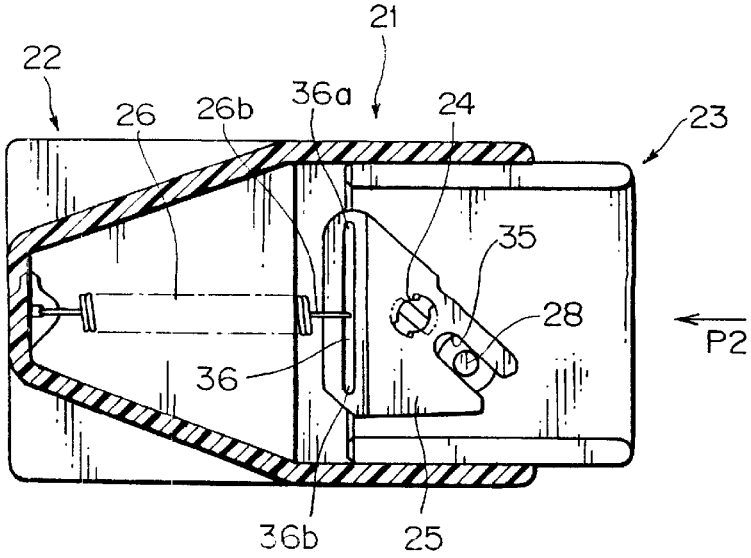
FIG. 10 is a horizontal section of the essential portions in FIG. 9.

If the driven member 25 is rotated up to the position, as shown in FIG. 10, in which the direction of the axis of the slide slit 36 is perpendicular to the not-shown axis of the female connector 22, the other end 26*b* of the spring 26 slides to a position near the above not-shown axis so as to escape the added pulling force of the spring 26, at which time the male terminal 30 is, at its electrical contact 30*a*, in contact, or almost in contact with the female terminal 37 (FIG. 9).

Until the other end 26*b* of the spring 26 slides to the position, as shown in FIG. 10, the spring 26, due to its restoring nature, acts on the driven member 25 in the direction of its counterclockwise rotation, thereby to concurrently produce a repulsion force which acts through the driven member 25 (at the cutout 35) on the drive portion 28 to push the male connector 23 outwardly.

Thus, in the halfway fitted condition as shown in FIGS. 9 and 10, due to the repulsion force acting on the male connector drive portion 28, the male connector 23 tends to be pushed out, thereby to prevent effecting an incomplete coupling.

Figure 11:
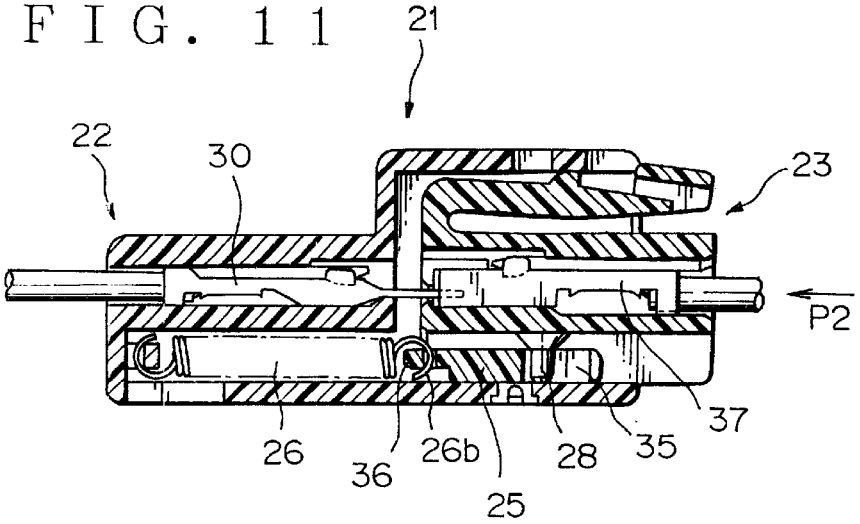
FIG. 11 is an essential portion vertical section of the connectors, shown in a condition further proceeded from the condition of FIG. 9.
Figure 12:
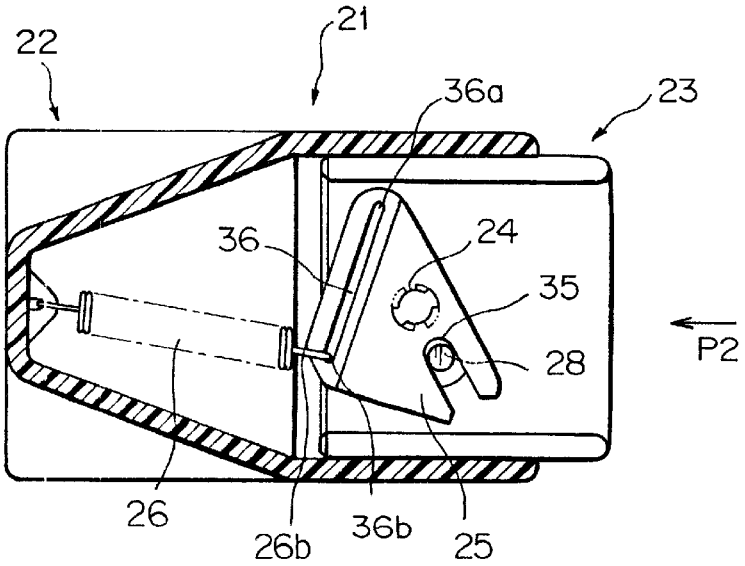
FIG. 12 is a horizontal section of the essential portions in FIG. 11.

If the male connector 23 is further pushed in, the drive portion 28 continues to slide in the cutout 35 to further rotate the driven member 25 clockwise as shown in FIGS. 11 and 12, during which the inclination of the slide slit 36 relative to the axis of the connectors switches (FIG. 12), so that the other end 26*b* of the spring 26 slides rapidly to the other end 36*b* of the slide slit 36 (FIG. 12). Concurrently, the male and female terminals 30 and 37 start to be connected (FIG. 11).

The spring 26, due to its restoring nature, pulls at the other end 36*b* of the slide slit 36, causing a drawing force at the cutout 35 which acts on the drive portion 28 in the direction of pulling the male connector 23. A reduction is thus made in the force required for inserting the male connector 23.

Figure 13:
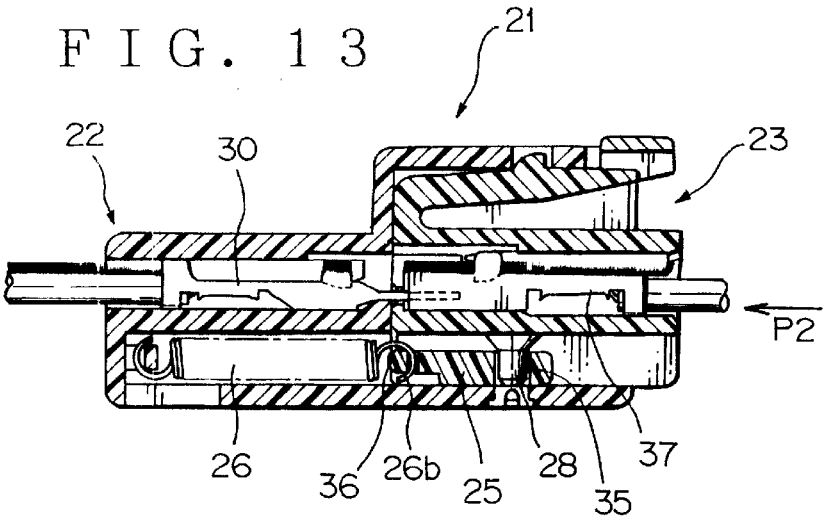
FIG. 13 is an essential portion vertical section of the connectors, shown in a full fitted condition.
Figure 14:
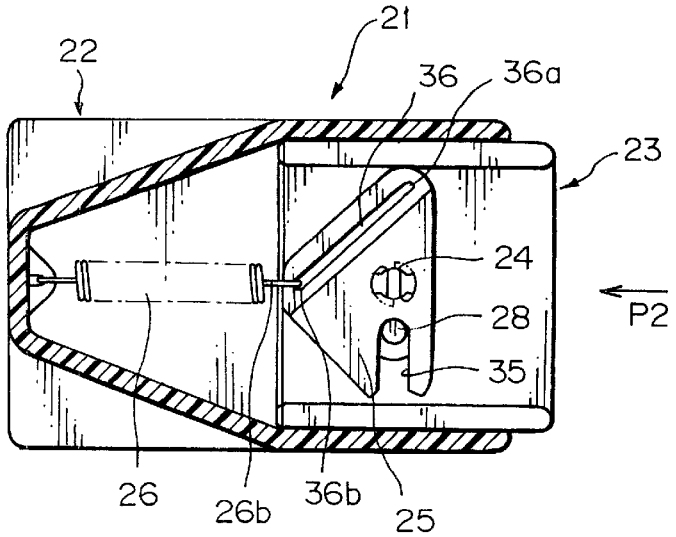
FIG. 14 is a horizontal section of the essential portions in FIG. 13.

If the male connector 23 is further pushed in the direction of the arrow P2, as shown in FIGS. 13 and 14, the male connector drive portion 28 slides, under the above drawing force, in the cutout 35, while causing a continued rotation of the driven member 25 until it reaches the innermost part of the cutout 35 (FIG. 14). By the time the driven member 25 is rotated to the position as shown in FIG. 14, the female and male connectors 22, 23 are fully coupled together with a low insertion force, completing the connection of the male and female terminals 30, 37 (FIG. 13).

To decouple the connectors 22, 23, the above operation is effected in reverse order, and on moving the male connector 23 in the direction opposite the arrow P2 in FIG. 14, the male connector drive portion 28 presses at the cutout 35 to rotate the driven member 25 counterclockwise, at which time the spring 26 is stretched to draw the driven member 25 with an increased pulling force.

As the male connector 23 is moved in the direction opposite the arrow P2 and the driven member 25 is rotated, the other end 26*b* of the spring 26 slides in the slide slit 36 to the position shown in FIG. 10 in a manner similar to that described above so as to escape the increased pulling force. On further moving the male connector 23 in the direction opposite the arrow P2, the other end 26*b* of the spring 26 slides rapidly to the one end 36*a* of the slide slit 36 as shown in FIG. 8. At this time, the spring 26, due to its restoring nature, pulls at the one end 36*a* of the slide slit 36, causing a repulsion force which acts through the driven member 25 (at the cutout 35) on the drive portion 28 in the direction of pushing out the male connector 23. Thus, the male connector 23 can be detached with a low force.

Thus, as described above with reference to FIGS. 4 to 14, by the other end 26*b* of the spring 26 which slides between the opposite ends 36*a*, 36*b* of the slide slit 36, the repulsion force and the drawing force for the male connector 23 can be switched during the process of rotating the driven member 25. In other words, in a halfway fitted condition, a repulsion force is produced which acts on the male connector 23 in the direction of its separation to thereby prevent an incomplete coupling, and subsequently, as the coupling operation proceeds, a drawing force is produced which acts on the male connector 23 in the direction of its complete coupling with the female connector 22, leading to a reliable coupling and an improved working efficiency.

A second embodiment of a connector assembly according to this invention will now be described with reference to FIGS. 15 to 24.

Figure 15:
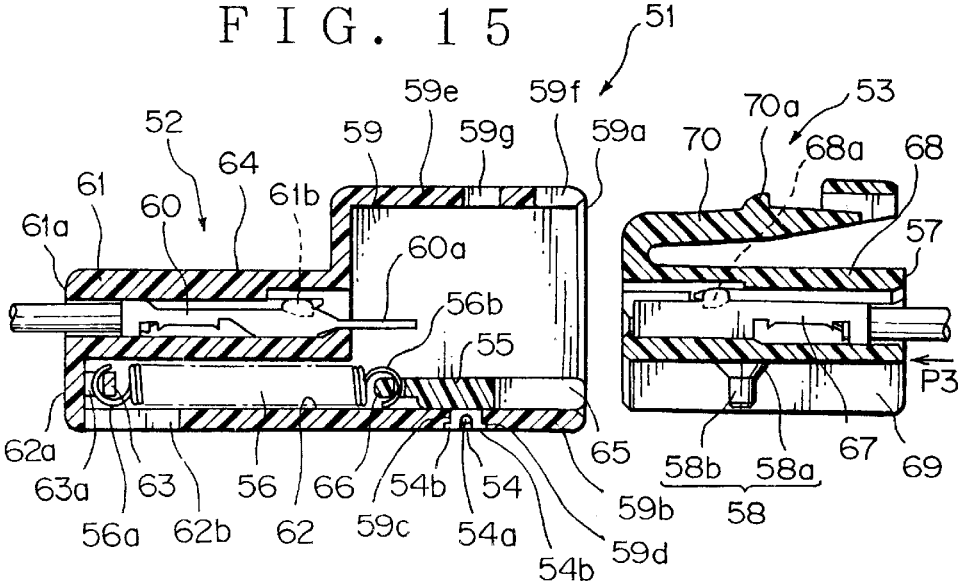
FIG. 15 is an essential portion vertical section of a second embodiment of a connector assembly according to this invention, shown with the connectors separated.
Figure 16:
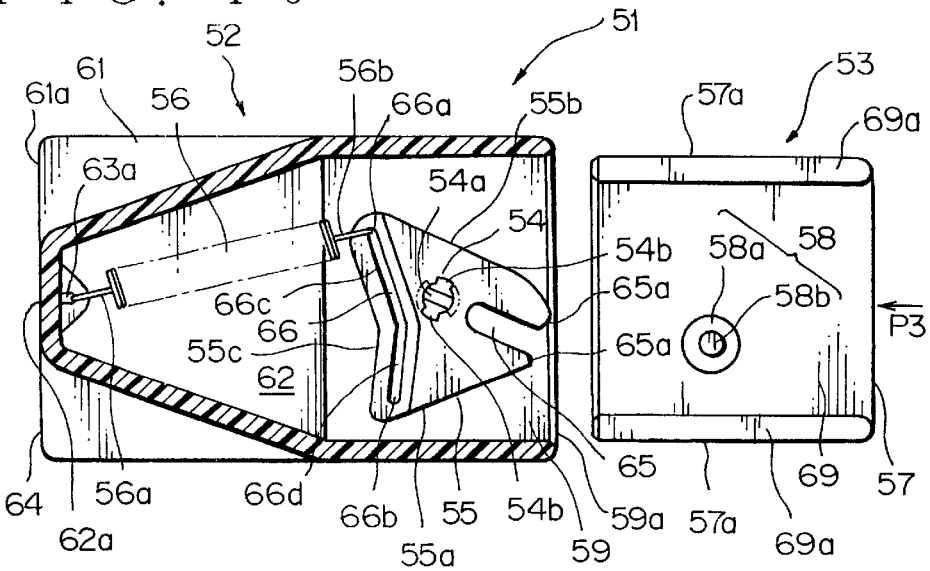
FIG. 16 is a horizontal section of the essential portions in FIG. 15.

FIG. 15 is a vertical section of an essential portion of the connectors according to the second embodiment, and FIG. 16 is a horizontal section of the essential portions in FIG. 15.

In FIGS. 15 and 16, denoted 51 is a connector assembly which is made up of a female connector 52 and a male connector 53 fittable to each other. The female connector 52 includes a driven member 55 with a shaft 54 and a tension spring 56. The male connector 53 has a drive portion 58 formed on its housing 57.

The female connector 52 has a rectangular receiving section 59 formed therein which opens at the front end 59*a* for receiving the housing 57 of the male connector 53, and a terminal accommodating section 61 with a row of known male terminals 60 accommodated therein (only one is shown in FIG. 15), the terminal accommodating section 61 adjoining the receiving section 59 at the rear e nd.

The female connector 52 internally has an empty space 62 in communication with the receiving section 59, which empty space is defined below the terminal accommodating section 61 (FIG. 15), and a triangular-shaped support 63 provided integrally on an inner rear wall 62*a* of the empty space 62.

A shaft hole 59*c* (FIG. 15) for the shaft 54 is provided in one wall 59*b* of the receiving section 59, the shaft hole having a pair of recesses 59*d*, 59*d* formed at its circumferential edge which cooperate with a later-described pair of rotation regulating projections 54*b*, 54*b* of the shaft 54 to restrict the rotation of the driven member 55. The wall 59*e* opposed to the one wall 59*b* has a recess 59*f* (FIG. 15) extending inwardly from the front end 59*a* in a stepped manner and a rectangular locking hole 59*g* (FIG. 15) formed therethrough on an inboard side of the stepped recess 59*f*.

The support 63 is provided with a throughhole 63*a* for hooking engagement therein of one end 56*a* of the spring 56. Denoted 62*b* (FIG. 15) is a work window for use in mounting the spring 56.

The driven member 55, constituted by a triangular-shaped plate of synthetic resin, has, in addition to the shaft 54, a cutout 65 and a slide slit 66, the shaft 54 being fittable into the shaft hole 59*c* (FIG. 15) to rotatably support the driven member 55 inside the receiving section 59.

The shaft 54 is of circular cross section (FIG. 15) and has a vertical slit 54*a* (FIG. 15) extending from the top end toward the driven member 55. The pair of rotation regulating projections 54*b*, 54*b* are provided on opposite sides of the slit 54*a* at the top end of the shaft 54.

The cutout 65 is of U-shape and provided at the entrance with tapers 65*a*, 65*a* and extends from a first side edge 55*a* of the driven member 55 in parallel to a second side edge 55*b* of same.

The slide slit 66, as shown in FIG. 16, is bent at an intermediate portion thereof into two straight portions, a first slit 66*c* and a second slit 66*d*, extends along a similarly bent or doglegged third side edge 55*c* of the driven member 55, and has one end 66*a* on the first slit 66*c* side and the other end 66*b* on the second slit 66*d* side. The slide slit 66 has a small width as compared with the cutout 65.

The shaft 54 is located on the axis (not shown) of the cutout 65. That part of the driven member 55 including the slide slit 66 is formed at a one-step lower level in thickness direction than the remainder of the driven member 55 for hooking engagement of the other end 56*b* of the spring 56 in the slide slit 66 (FIG. 15).

The male connector 53, as shown in FIG. 15, includes a housing 57 of substantially rectangular shape with a rectangular-shaped terminal accommodating section 68 formed therein for receiving a row of known female terminals 67 (only one is shown in FIG. 15). The housing 57 has a drive portion-containing space section 69 formed at one vertical side of the terminal accommodating section 68, the drive portion-containing space section containing the drive portion 58. At the other vertical side of the terminal accommodating section 68 is provided a locking arm 70.

The drive portion-containing space section 69, as shown in FIG. 16, is laterally defined by side walls 69*a*, 69*a* of the housing 57, and the drive portion 58 is located therein at such position as will enter the cutout 65 when coupling the connectors 52, 53.

The drive portion 58 consists of a ring-shaped seat 58*a* and a pin 58*b* of circular cross section errected on the seat 58*a*.

The locking arm 70 is of known structure and is provided with a locking projection 70*a* for locking engagement in the locking hole 59*g*.

The assemblage of the female and male connectors 52 and 53 will now be described with reference to FIGS. 15 and 16.

First, description is made of the female connector 52.

As shown in FIG. 15, the terminal receiving section 61 has wired male terminals 60 locked therein with related lances 61*b*. The electrical contact 60*a* of each male terminal 60 is located protruding into the receiving section 59.

The driven member 55 is mounted on the inner side of the one wall 59*b* of the receiving section 59, with its shaft 54 fitted in the shaft hole 59*c*. The spring 56, one end 56*a* thereof attached to the support 63, is at the other end 56*b* slidably engaged in the slide slit 66 at the one end 66*a*. The spring 56 is normally stretched to some extent to pull at the one end 66*a* of the slide slit 66.

The shaft 54 and the support 63, as indicated in FIG. 16, are located on the same axis (not shown) of the female connector 52. The driven member 55 has its cutout 65 located on a side closer to the male connector 53. Thus, the driven member 55 is disposed so that its first to third side edges 55*a* to 55*c* are inclined relative to the not-shown axis of the female connector 52. Due to the rotation regulating projections 54*b*, 54*b* which restrict the rotation of the driven member 55, the spring 56 is disposed inclined to the not-shown axis of the female connector 52 as shown in FIG. 16.

Description will now be made of the male connector 53.

As shown in FIG. 15, the terminal accommodating section 68 has wired female terminals 67 locked therein with related lances 68*a*.

The drive 58 is located at an offset position from the axis (not shown) of the male terminal 53 as shown in FIG. 16 so as to enter the cutout 65 as mentioned above.

The coupling operation of the female and male connectors 52 and 53 will now be described with reference to FIGS. 15 to 24, each two of which, for example, FIGS. 15 and 16, FIGS. 17 and 18, . . . are paired, odd figures being longitudinal sections and even figures being horizontal sections showing essential portions in the related odd figures.

The female connector 52 and the male connector 53, as shown in FIGS. 15 and 16, are arranged in opposed relation to be coupled, followed by moving the male connector 53 in the direction of an arrow P3 to start the coupling.

Figure 17:
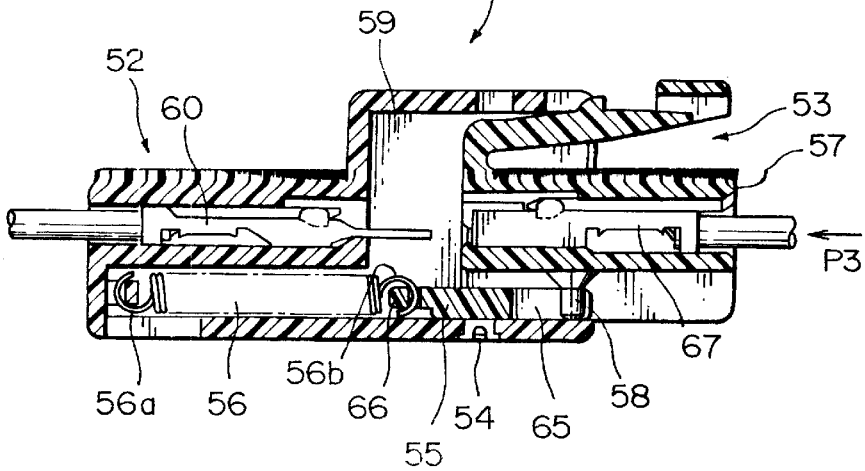
FIG. 17 is an essential portion vertical section of the connectors, shown in a halfway fitted condition.
Figure 18:
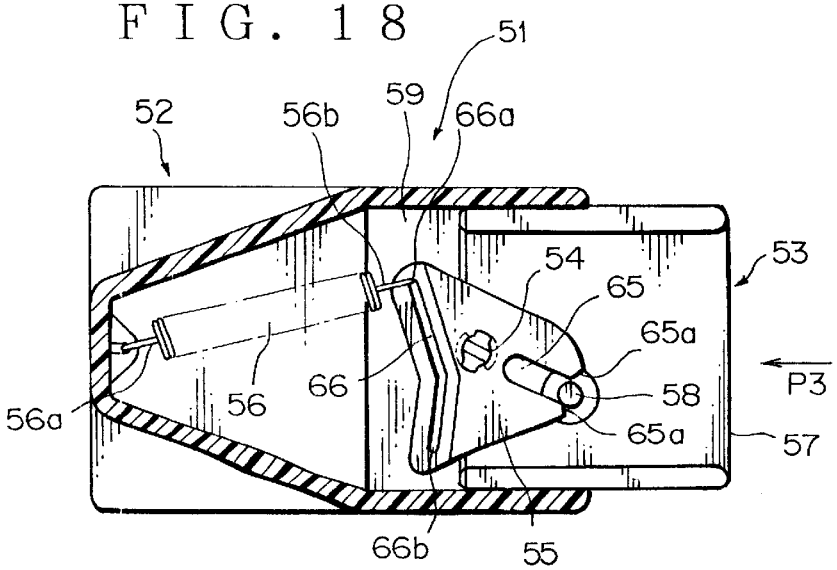
FIG. 18 is a horizontal section of the essential portions in FIG. 17.

If the male connector 53 advances halfway into the receiving section 59 of the female connector 52 as shown in FIGS. 17 and 18, the male connector drive portion 58 arrives at the tapers 65*a*, 65*a* at the entrance of the cutout 65 (FIG. 18), at which time the male and female terminals 60 and 67 are still not in contact with each other (FIG. 17).

On further pushing the male connector 53 in the direction of the arrow P3, the male connector drive portion 58 engages and slides in the cutout 65, while causing a clockwise rotation of the driven member 55 on the drawing. The spring 56 is stretched in compliance therewith, with the result that an addition is made to its pulling force.

Figure 19:
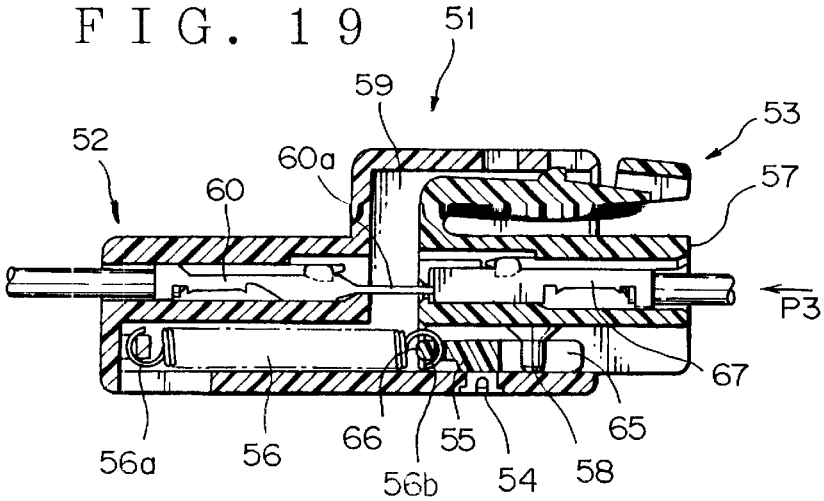
FIG. 19 is an essential portion vertical section of the connectors, shown in a condition proceeded from the condition of FIG. 17.
Figure 20:
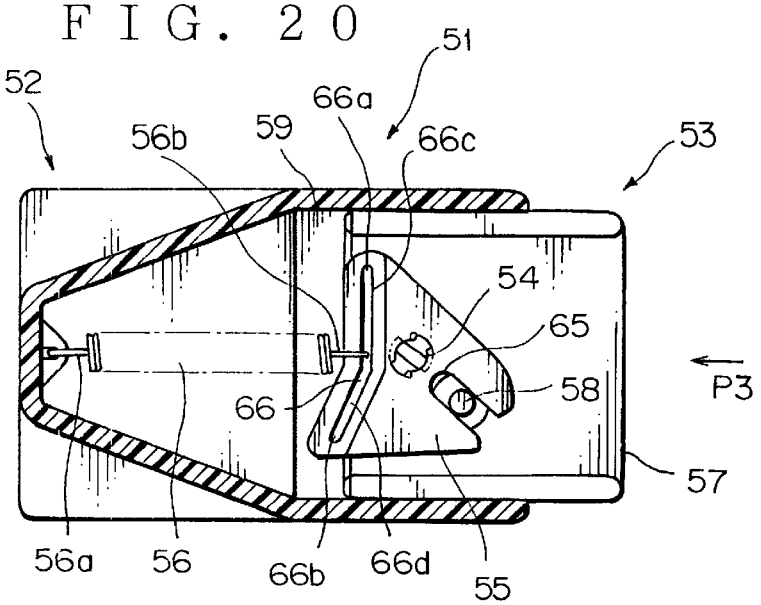
FIG. 20 is a horizontal section of the essential portions in FIG. 19.

If the driven member 55 is rotated up to the position as shown in FIG. 20 in which the direction of axis the of the first slit 66*c* is perpendicular to the not-shown axis of the female connector 52, the other end 56*b* of the spring 56 slides to a position near the above not-shown axis so as to escape the added pulling force, at which time the male terminal 60 is, at the tip end of its electrical contact 60*a*, in contact, or almost in contact, with the female terminal 67 (FIG. 19).

Until the other end 56*b* of the spring 56 slides to the position as shown in FIG. 20, the spring 56, due to its restoring nature, acts on the driven member 55 in the direction of its counterclockwise rotation, thereby to concurrently produce a repulsion force which acts through the driven member 55 (at the cutout 65) on the drive portion 58 to push the male connector 53 outwardly.

Thus, in the halfway fitted condition as shown in FIGS. 19 and 20, due to the repulsion force acting on the male connector drive portion 58, the male connector 53 tends to be pushed out, thereby to prevent an incomplete coupling.

Figure 21:
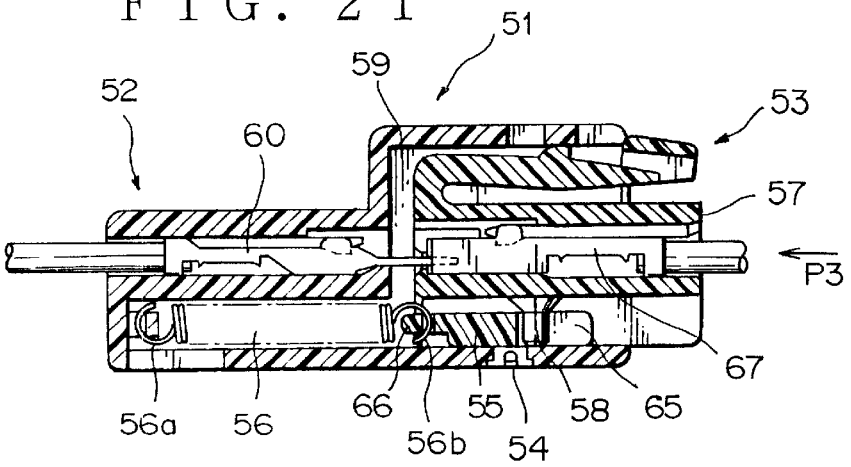
FIG. 21 is an essential portion vertical section of the connectors, shown in a condition further proceeded from the condition of FIG. 19.
Figure 22:
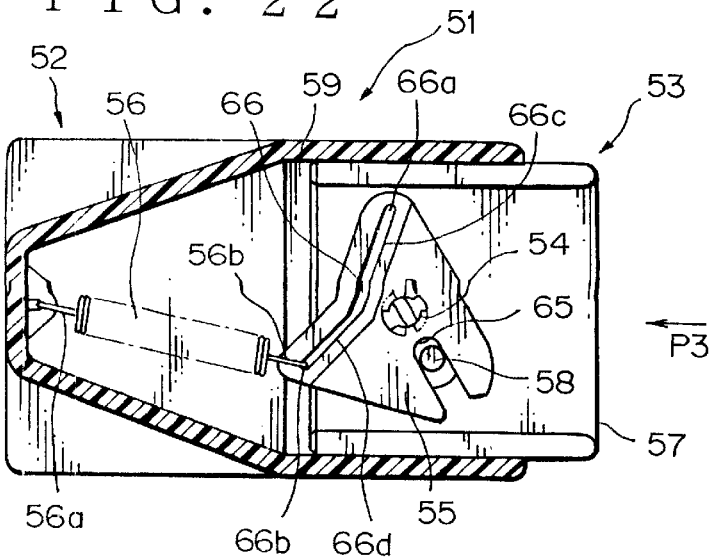
FIG. 22 is a horizontal section of the essential portions in FIG. 21.

If the male connector 53 is further pushed in the direction of the arrow P3, as shown in FIGS. 21 and 22, the drive portion 58 continues sliding in the cutout 65 to further rotate the driven member 55 clockwise, during which the inclination of the slide slit 66, especially at the second slit 66*d*, turns largely relative to the axis of the connectors, with the result that the other end 56*b* of the spring 56 slides rapidly to the other end 66*b* of the slide slit 66 (FIG. 22). At this time, the male and female terminals 60 and 67 start to be connected together (FIG. 21). Further, because the spring 56, due to its restoring nature, pulls at the other end 66*b* of the slide slit 66, a drawing force is produced which acts through the driven member 55 (at the cutout 65) on the drive 58 portion in the direction of drawing the male connector 53. A reduction is thus made in the force required for coupling the connectors together.

Figure 23:
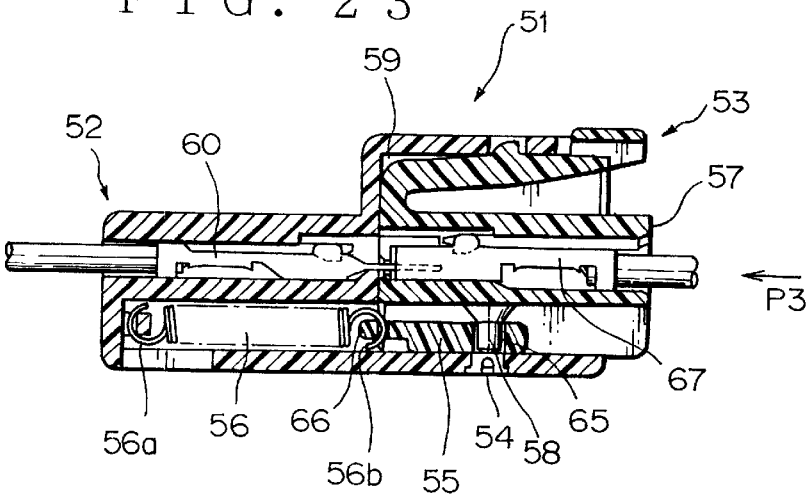
FIG. 23 is an essential portion vertical section of the connectors, shown in a full fitted condition.
Figure 24:
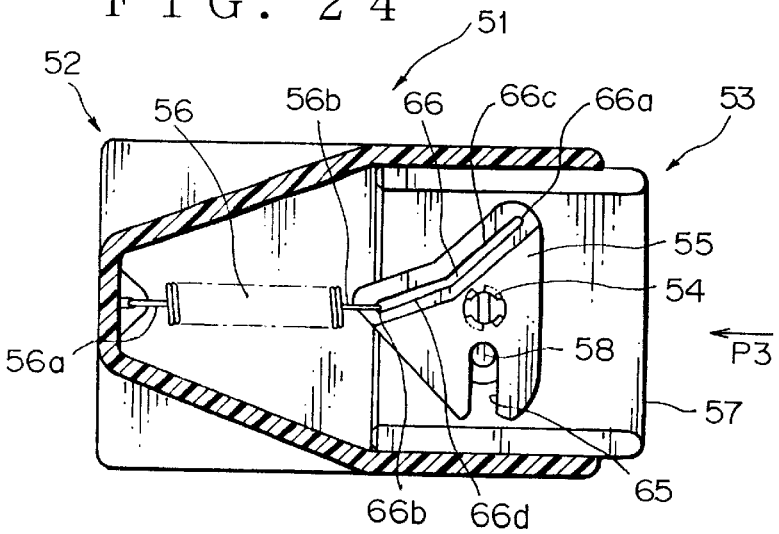
FIG. 24 is a horizontal section of the essential portions in FIG. 23.

If the male connector 53 is further pushed in the direction of the arrow P3, as shown in FIGS. 23 and 24, the drive portion 58 slides, under the above drawing force, in the cutout 65, while causing a continued rotation of the driven member 55 until it reaches the innermost part of the cutout 65. By the time the driven member 55 is rotated to the position as shown in FIG. 24, the female and male connectors 52, 53 are fully coupled together with a low insertion force, completing the connection of the male and female terminals 60, 67 (FIG. 23).

To decouple the connectors 52, 53, the above operation is effected in reverse order, and on moving the male connector 53 in the direction opposite the arrow P3 in FIG. 24, the male connector drive portion 58 presses at the cutout 65 to rotate the driven member 55 counterclockwise, at which time the spring 56 is stretched to draw the driven member 55 with an increased pulling force.

As the male connector 53 is moved in the direction opposite the arrow P3 and the driven member 55 is rotated, the other end 56*b* of the spring 56 slides in the slide slit 66 to the position shown in FIG. 20 in a manner similar to that described above so as to escape the increased pulling force. On further moving the male connector 53 in the direction opposite the arrow P3, the other end 56*b* of the spring 56, due to the first slit 66*c* which inclines largely relative to the axis of the connectors, slides at a dash to the one end 66*a* of the slide slit 66 as shown in FIG. 18. At this time, the spring 56, due to its restoring nature, pulls at the one end 66*a* of-the slide slit 66, causing a repulsion force which acts through the driven member 55 (at the cutout 65) on the drive portion 58 in the direction of pushing out the male connector 53. Thus, the male connector 53 can be detached with a low force.

Thus, as described above with reference to FIGS. 15 to 24, by the other end 56*b* of the spring 56 which slides between the opposite ends 66*a*, 66*b* of the bent slide slit 66, the repulsion force and the drawing force for the male connector 53 can be switched during the process of rotation of the driven member 55. In other words, in a halfway fitted condition, a repulsion force is produced which acts on the male connector 53 in the direction of its separation to thereby prevent an incomplete coupling, and subsequently, as the coupling operation proceeds, a drawing force is produced which acts on the male connector 53 in the direction of its complete coupling with the female connector 52, leading to a reliable coupling and an improved working efficiency.

FIGS. 25 to 30 are second conceptual views for the third embodiment of a connector assembly according to this invention. The third embodiment of this invention, which is based on the second concept, will be later described with reference to FIGS. 31 to 41. First, the second concept will be described.

Figure 25:
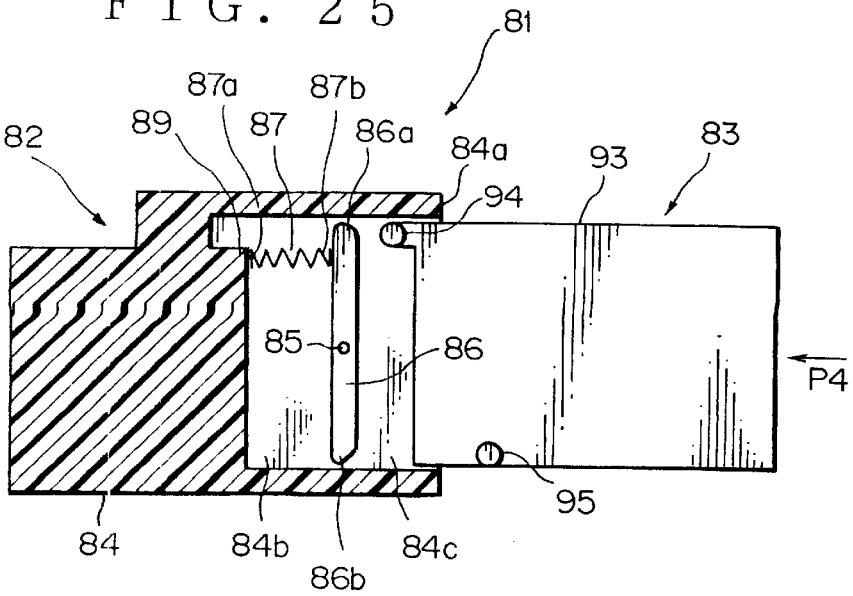
FIG. 25 is a second conceptual view for a third embodiment of a connector assembly according to this invention, showing in vertical section essential portions of the connectors at the start of their coupling.
Figure 26:
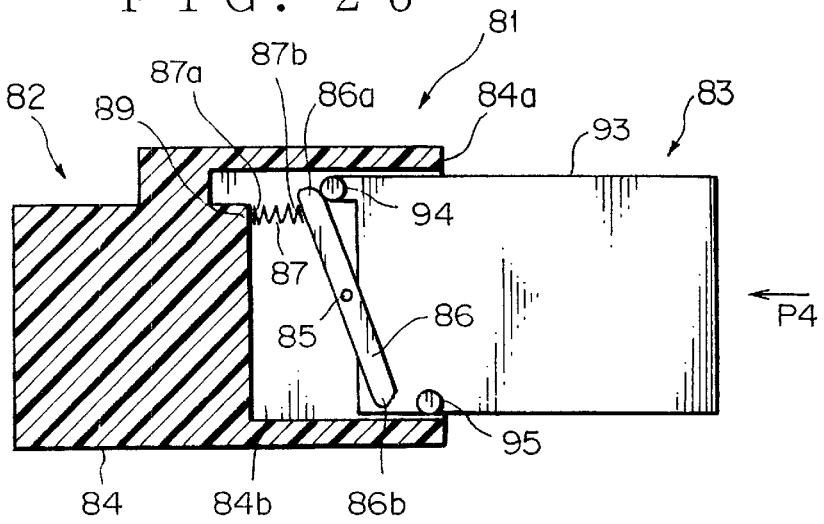
FIG. 26 is an essential portion vertical section of the connectors, shown in a halfway fitted condition proceeded from the condition of FIG. 25, where a repulsion force is acting.
Figure 27:
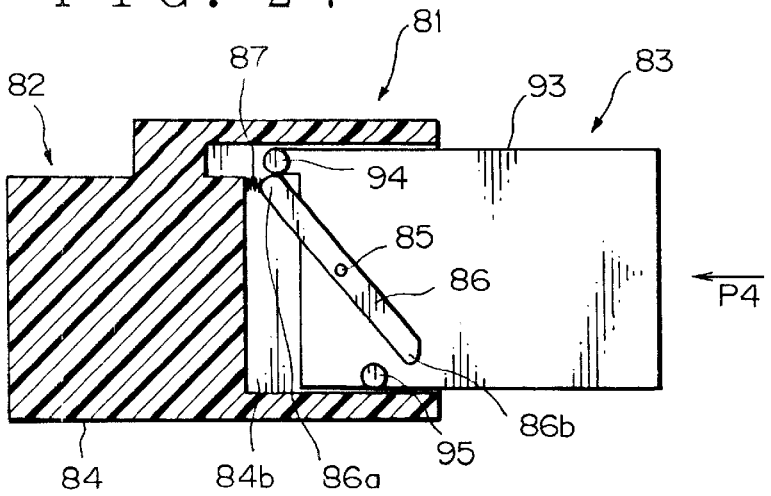
FIG. 27 is an essential portion vertical section of the connectors, shown in a condition proceeded from the condition of FIG. 26, where a drive portion is disengaged from a driven member.
Figure 28:
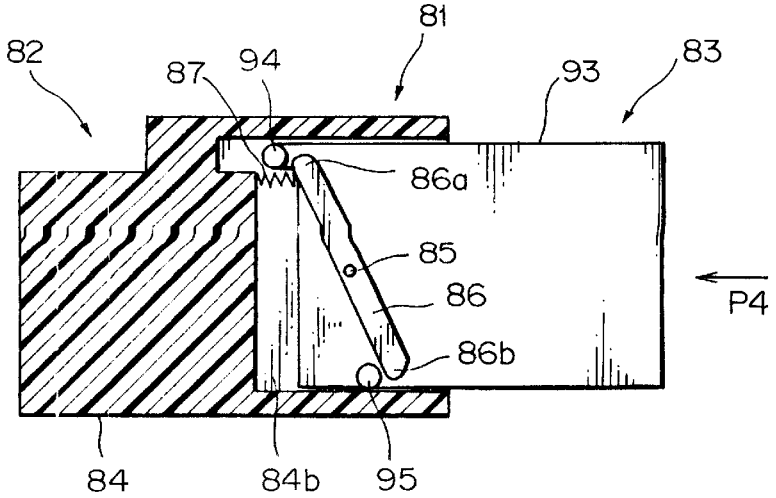
FIG. 28 is an essential portion vertical section of the connectors, shown in a condition further proceeded from the condition of FIG. 27, where a drawing force starts to act.
Figure 29:
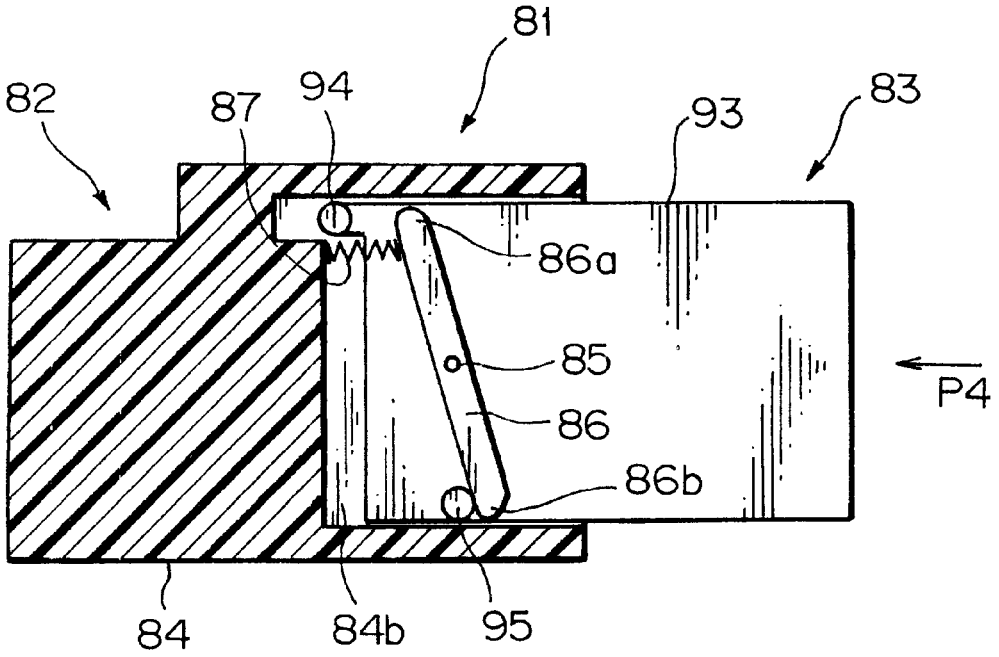
FIG. 29 is an essential portion vertical section of the connectors, shown in a condition further proceeded from the condition of FIG. 28, where the drawing force is acting.
Figure 30:
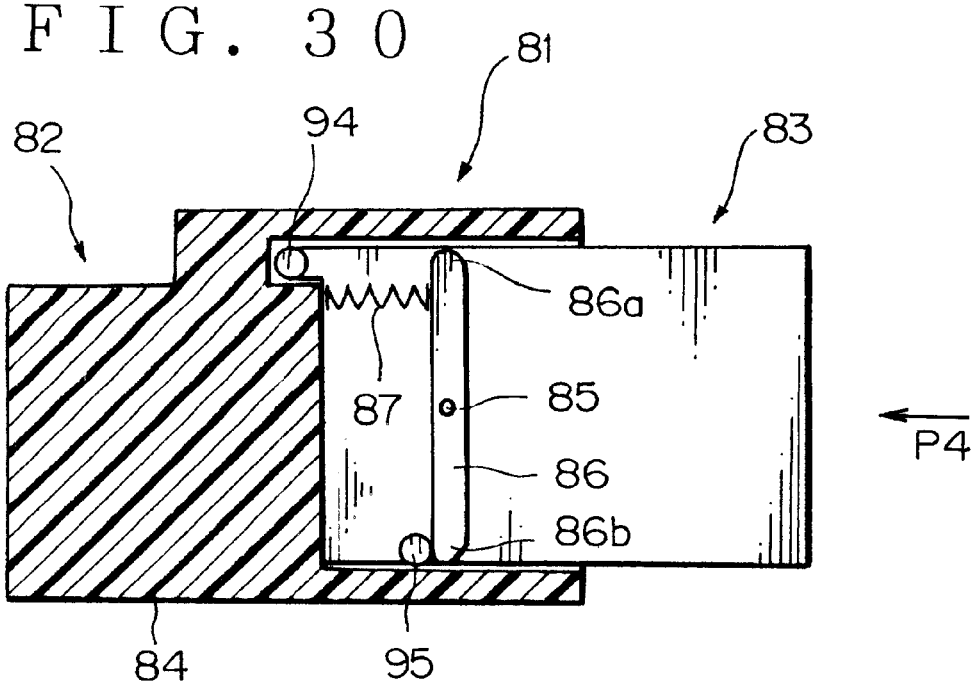
FIG. 30 is an essential portion vertical section of the connectors, shown in a full fitted condition.

FIG. 25 is a vertical section of essential portions of connectors according to this invention, FIG. 26 is an essential portion vertical section of the connectors halfway fitted and under repulsion, FIG. 27 is an essential portion vertical section of the connectors in a condition where their drive portion and driven member are disengaged, FIG. 28 is an essential portion vertical section of the connectors at the start of a drawing force, FIG. 29 is an essential portion vertical section of the connectors under the drawing force, and FIG. 30 is an essential portion vertical section of the connectors fully coupled.

In FIG. 25, denoted 81 is a connector assembly made up of a female connector 82 and a male connector 83 fittable to each other. For simplicity of description, male and female wired terminals of known structure which are received in the respective female and male connectors 82, 83, a known locking mechanism, and the like, for these connectors are omitted.

The female connector 82 includes a housing 84 of synthetic resin with a receiving section 84*b* formed therein, the receiving section 84*b* opening at the front end 84*a* of the housing 84 on a fitting side with the male connector 83, a driven member 86 rotatable about a shaft 85 provided on an inner side wall 84*c* of the housing 84, and a spring 87 provided between the housing 84 and the driven member 86, the receiving section 84*b* internally having a support 89 for the spring 87.

The driven member 86 is of rod-like shape and is rotatably supported at an intermediate portion thereof between one end 86*a* and the other end 86*b* by the shaft 85.

The spring 87, a known compression spring, is at one end 87*a* rotatably or fixedly supported on the support 89 and at the other end 87*b* rotatably or fixedly supported on the one end 86*a* of the driven member 86.

The shaft 85 is provided with not-shown rotation regulator means for restricting the rotation of the driven member 86.

The male connector 83 includes a housing 93 of synthetic resin which is received in the receiving section 84*b* of the female connector 82. The housing 93 has a projecting drive portion 94 of substantially circular cross section which, during coupling with the female connector 82, comes into contact with the one end 86*a* of the driven member 86, and a projecting urged portion 95 of substantially circular cross section at which, during coupling, the male connector 83 is urged by the other end 86*b* of the driven member 86.

The coupling operation of the above connectors 82 and 83 will now be described with reference to FIGS. 25 to 30.

The female connector 82 and the male connector 83 are arranged in opposed relation to be coupled, as shown in FIG. 25, followed by moving the male connector 83 in the direction of an arrow P4 to start the coupling.

As the male connector 83 advances into the female connector 82, the male connector drive portion 94 comes into contact with the driven member 86 to rotate same counterclockwise on the drawing, compressing the spring 87, as shown in FIG. 26. At this time, the compressed spring 87, due to its restoring nature, produces a repulsion force which acts through the driven member 86 (at the one end 86*a* side) on the drive portion 94 in a direction which tends to repel and push out the male connector 83, with the result that an incomplete coupling can be prevented.

If the male connector 83 is further pushed in the direction of the arrow P4, the drive portion 94, as shown in FIG. 27, disengages from the driven member 86 to release the driven member its counterclockwise rotation, and the spring 87 urges the driven member 86 to rotate in a clockwise direction as shown in FIG. 28. Concurrently with the above, a drawing force is generated which acts through the driven member 86 at the other end 86*b* side on the urged portion 95 in the direction of drawing the male connector 83. In other words, as shown in FIG. 29, the other end 86*b* of the driven member 86 abuts against and presses on the urged portion 95 to push the latter and thus the male connector 83 deeper into the female connector 82. The male connector 83 is thus pushed in the direction of the arrow P4 under the drawing force into a full fitted position with the female connector 82 as shown in FIG. 30.

A reduction is thus made in the force required for the fitting operation and a so-called low coupling force connector assembly is attained, leading to an improved working efficiency.

To decouple the connectors 82, 83, the above operation is effected in reverse order, and on moving the male connector 83 in the direction opposite the arrow P4 in FIG. 30, the urged portion 95 presses on the other end 86*b* of the driven member 86 and rotates the driven member 86 counterclockwise, at which time the spring 87 is compressed to add to its pushing force and produce a drawing force at the other end 86*b* of the driven member 86.

As the male connector 83 is further moved in the direction opposite the arrow P4, the urged portion 95, as shown in FIG. 27, disengages from the driven member 86 to release the driven member from the counterclockwise rotation, and the spring 87 urges the driven member 86 to rotate in the clockwise rotation as shown in FIG. 26, at which time the driven member 86 at the one end 86*a* comes into contact with the drive portion 94. The repulsion force produced by the compressed spring 87 thus acts on the drive portion 94 in the direction of pushing out the drive portion and thus the male connector 93. Consequently, as shown in FIG. 25, the male and female connectors 83 and 82 can be decoupled with a low force.

Thus, as described above with reference to FIGS. 25 to 30, while the drive portion 94 is pressing on the driven member 86, the compressed spring 87 causes a repulsion force at the one end 86*a* side of the driven member 86 which acts on the drive portion 94 in the direction of repelling the male connector 83, and when the driven member 86 is disengaged from the drive portion 94, the spring 87 urges the driven member 86 to rotate in reverse direction so that its other end 86*b* abuts against, and acts on, the urged portion 95 in the direction of pushing the male connector 83 into a fitted condition with the female connector 82.

Thus, with the arrangement as described above, through cooperation of the drive portion 94 and the urged portion 95 with the driven member 86, the male connector repelling force and drawing force can be produced in order, leading to a reliable coupling with a low force and an improved working efficiency.

A third embodiment of a connector assembly according to this invention will now be described with reference to FIGS. 31 to 41.

Figure 31:
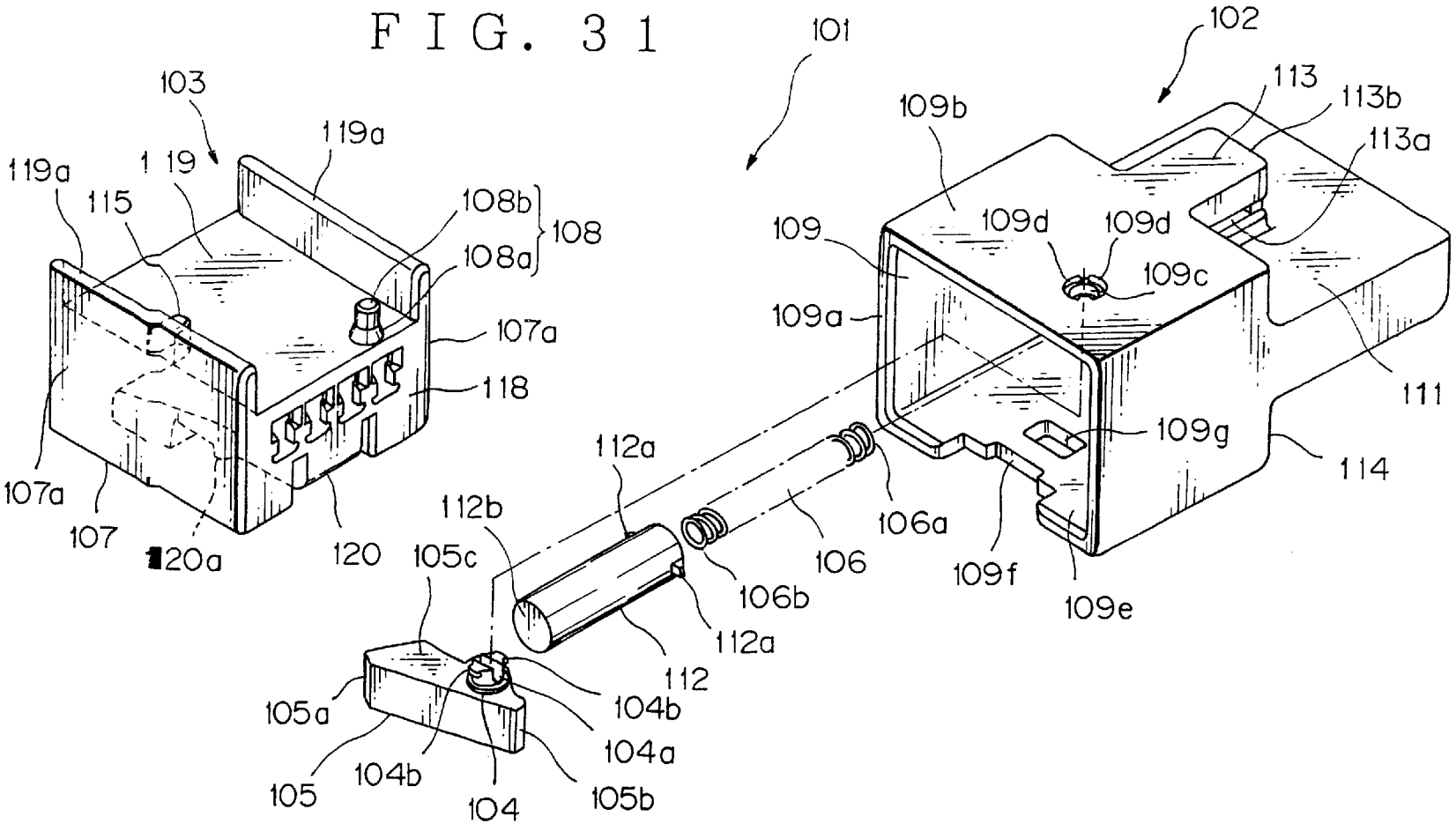
FIG. 31 is an exploded perspective view of a third embodiment of a connector assembly according to this invention.
Figure 32:
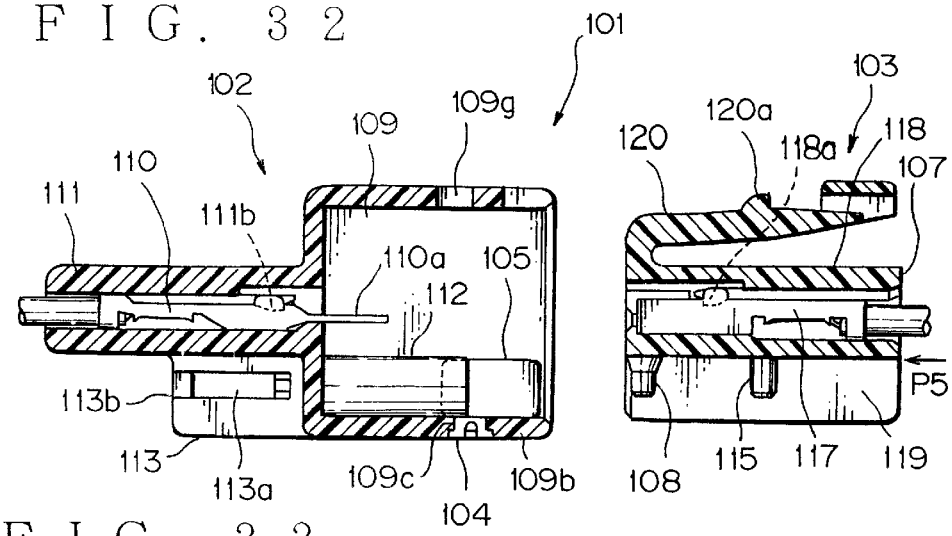
FIG. 32 is an essential portion vertical section of the connectors of FIG. 31.
Figure 33:
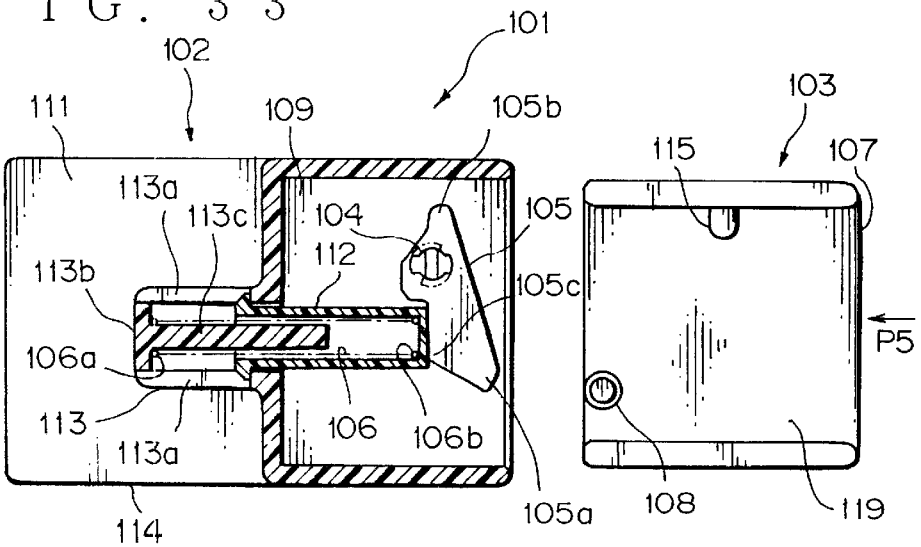
FIG. 33 is a horizontal section of the essential portions in FIG. 32.

FIG. 31 is an exploded perspective view of the connector assembly according to the third embodiment, with the connector assembly shown upside down for convenience of explanation, FIG. 32 is an essential portion vertical section of the connector assembly of FIG. 31, and FIG. 33 is an essential portion horizontal section of the connector assembly of FIG. 32.

In FIG. 31, denoted 101 is a connector assembly which is made up of a female connector 102 and a male connector 103 fittable to each other. The female connector 102 is provided with a driven member 105 with a shaft 104, a tension spring 106, and an indirect member 112. The male connector 103 has a drive portion 108 and an urged portion 115, both formed on its housing 107.

The female connector 102 includes a rectangular receiving section 109 which opens at the front end 109*a* for receiving the housing 107 of the male connector 103, a terminal accommodating section 111 with a row of known male terminals 110 accommodated therein (only one is shown in FIG. 32), the terminal accommodating section 111 adjoining the receiving section 109 at the rear end, and a rectangular support 113 which has slits 113*a*, 113*a* (FIG. 33) and in which the indirect member 112 is slidable.

A shaft hole 109*c* for the shaft 104 is provided in one wall 109*b* of the receiving section 109, the shaft hole having a pair of recesses 109*d*, 109*d* formed at its circumferential edge which cooperate with a later-described pair of rotation regulating projections 104*b*, 104*b* of the shaft 104 to restrict the rotation of the driven member 105. The wall 109*e* opposed to the one wall 109*b* has a recess 109*f* extending inwardly from the front end 109*a* in a stepped manner and a rectangular locking hole 109*g* formed there-through on an inboard side of the stepped recess 109*f*.

The support 113 is of closed-end cylindrical shape, and has the slits 113*a*, 113*a* at opposite sides, and a round pin-like rod member 113*c* which extends from the bottom wall 113*b* of the support 113 into the interior of the spring 106 to prevent a collapse of the spring.

The indirect member 112 is of closed-end cylindrical shape capable of receiving the other end 106*b* of the spring 106 and is provided on its periphery with projections 112*a*, 112*a* slidable in the slits 113*a*, 113*a* (FIG. 33). The closed-end constituting front end wall 112*b* of the indirect member 112 has a flat surface engageable with the driven member 105.

The driven member 105, which is constituted by a cam-like plate of synthetic resin, has a first engagement portion 105*a* for the drive portion 108, a second engagement portion 105*b* for the urged portion 115, a cam portion 105*c* for the indirect member 112, and the shaft 104 which is fitted into the shaft hole 109*c* to rotatably support the driven member 105 inside the receiving section 109.

The shaft 104 is substantially of circular cross section and has a vertical slit 104*a* extending from the top end toward the driven member 105. The pair of rotation regulating projections 104*b*, 104*b* are provided on opposite sides of the slit at the top end of the shaft 104.

The male connector 103 includes a rectangular housing 107 with a rectangular-shaped terminal accommodating section 118 formed therein for receiving a row of known female terminals 117 (only one is shown in FIG. 32). The housing 107 has a drive portion-containing space section 119 formed at one vertical side of the terminal accommodating section 118, the drive portion-containing space section containing the drive portion 108 and the urged portion 115. At the other vertical side of the terminal accommodating section 118 is provided a locking arm 120. The drive portion-containing space section 119 is laterally defined by side walls 119*a*, 119*a* of the housing 107, and the drive portion 108 and the urged portion 115 are located therein at such positions as will come into contact with the first engagement portion 105*a* and the second engagement portion 105*b* of the driven member 105, respectively, when fitting the connectors 102, 103. The drive portion 108 consists of a ring-shaped seat 108*a* and a pin 108*b* of circular cross section erected on the seat 108*a*. The urged portion 115 is a pin member located adjoining the side wall 119*a* and having a U-shaped cross section. The locking arm 120 is of known structure and is provided with a locking projection 120*a* for locking engagement in the locking hole 109*g*.

The assemblage of the female and male connectors 102 and 103 will now be described with reference to FIGS. 32 and 33.

First, description is made of the female connector 102.

As shown in FIG. 32, the terminal receiving section 111 has wired male terminals 110 locked therein with related lances 111*b*. The electrical contact 110*a* of the male terminal 110 is located protruding into the receiving section 109.

The driven member 105 is mounted on the inner side of the one wall 109*b* of the receiving section 109, with its shaft 104 fitted in the shaft hole 109*c*. As shown in FIG. 33, the spring 106 is sleeved over the rod member 113*c* inside the support 113, and the indirect member 112, which receives the other end 106*b* side of the spring 106, is longitudinally slidably mounted in the support 113.

The shaft 104 and the support 113, as indicated in FIG. 33, are offset from the axis (not shown) of the female connector 102. The driven member 105 has its first engagement portion 105*a* located on a side closer to the male connector 103.

Description will now be made of the male connector 103.

As shown in FIG. 32, the terminal accommodating section 118 has wired female terminals 117 locked therein with related lances 118*a*.

The drive portion 108 and the urged portion 115 are located on opposite sides of the not-shown axis of the male connector 103 such that, as described above, the drive portion 108 comes into abutment against the first engagement portion 105*a* of the driven member 105 and the urged portion 115 comes into abutment against the second engagement portion 105*b*.

The coupling operation of the female and male connectors 102 and 103 will now be described with reference to FIGS. 32 to 41, each two of which, for example, FIGS. 32 and 33, FIGS. 34 and 35, . . . are paired, odd figures being longitudinal sections and even figures being horizontal sections showing essential portions of the related odd figures.

Figure 34:
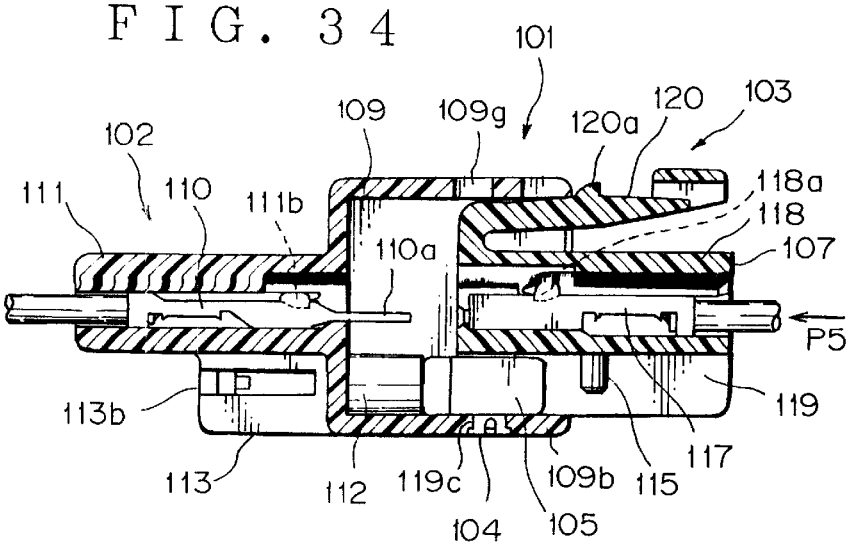
FIG. 34 is an essential portion vertical section of the connectors, shown in a halfway fitted condition.
Figure 35:
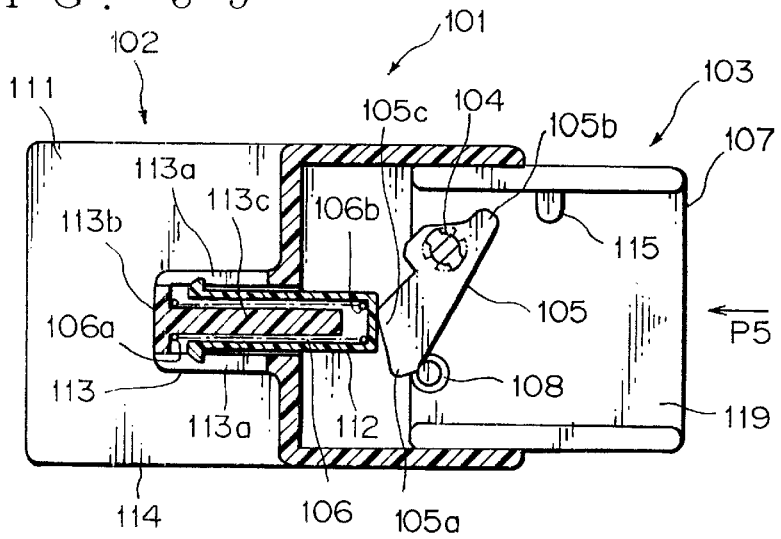
FIG. 35 is a horizontal section of the essential portions in FIG. 34.

As shown in FIGS. 32 and 33, the female connector 102 and the male connector 103 are disposed in opposed relation capable of fitting together, and the male connector 103 is moved in the direction of an arrow P5 to start the coupling. As shown in FIGS. 34 and 35, when the drive portion 108 of the male connector 103 comes into contact with and presses on the first engagement portion 105*a* of the driven member 105, the driven member 105 rotates clockwise on the drawing, compressing the spring 106 through the indirect member 112. At this time, the male and female terminals 110 and 117 are still not in contact with each other (FIG. 34).

When compressed, a repulsion force is produced at the spring 106 which acts through the first engagement portion 105*a* of the driven member 105 in a direction which tends to push back the male connector 103 outwardly. Accordingly, in a halfway fitted condition as shown in FIGS. 34 and 35, the male connector 103 is pushed out, thereby to prevent an incomplete fitting of the connectors 102, 103.

Figure 36:
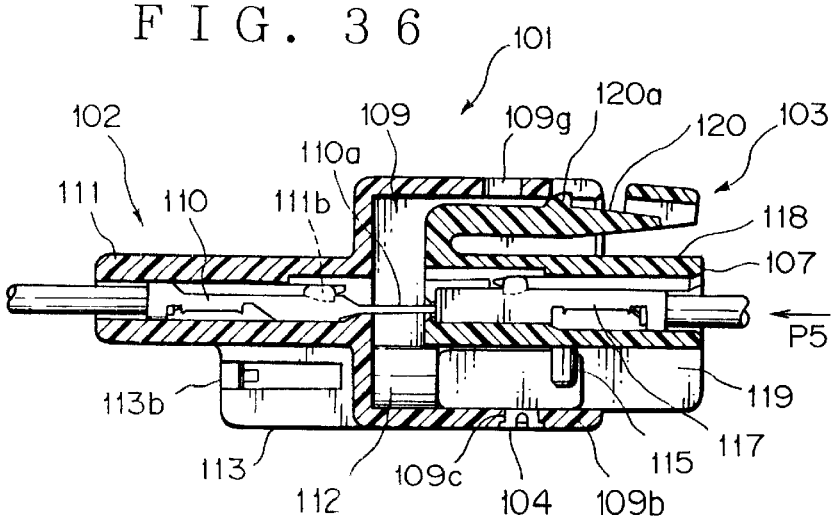
FIG. 36 is an essential portion vertical section of the connectors, shown in a condition proceeded from the condition of FIG. 34.
Figure 37:
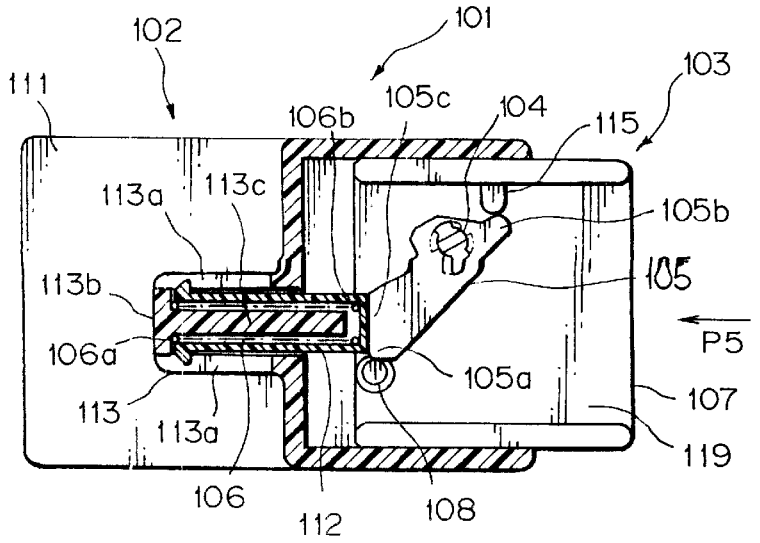
FIG. 37 is a horizontal section of the essential portions in FIG. 36.
Figure 38:
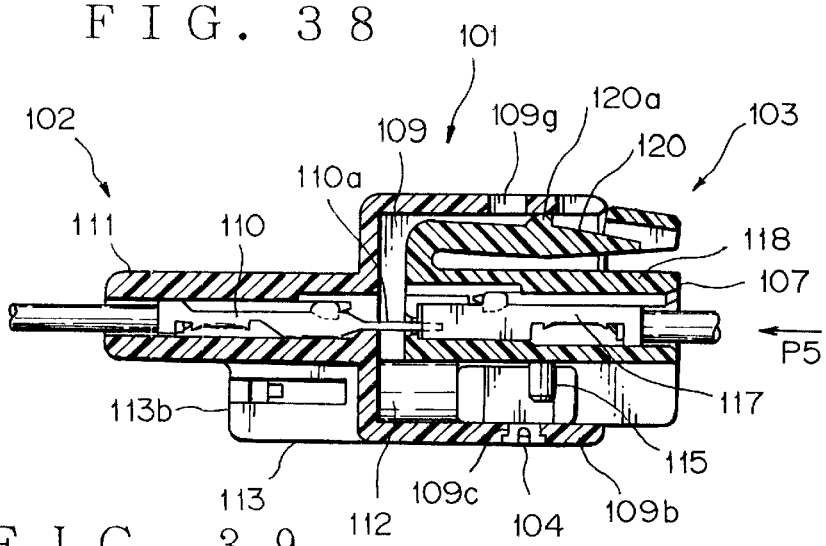
FIG. 38 is an essential portion vertical section of the connectors, shown in a condition further proceeded from the condition of FIG. 36.
Figure 39:
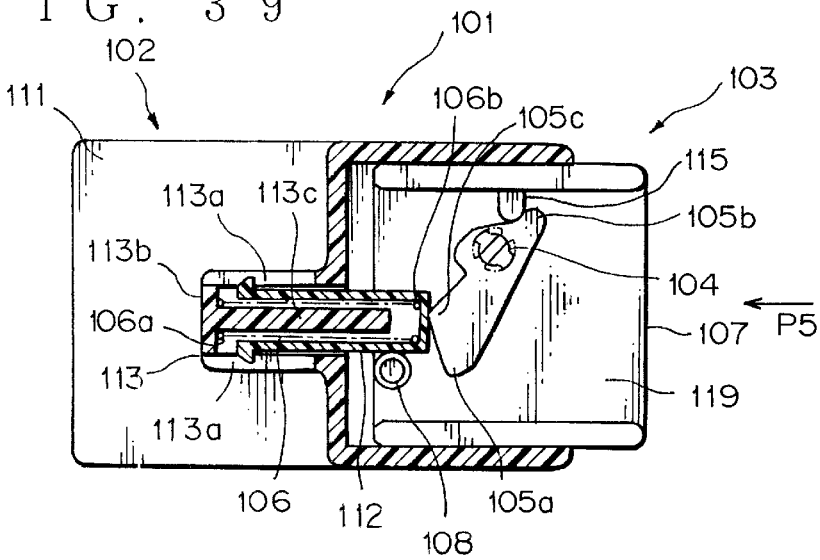
FIG. 39 is a horizontal section of the essential portions in FIG. 38.
Figure 40:
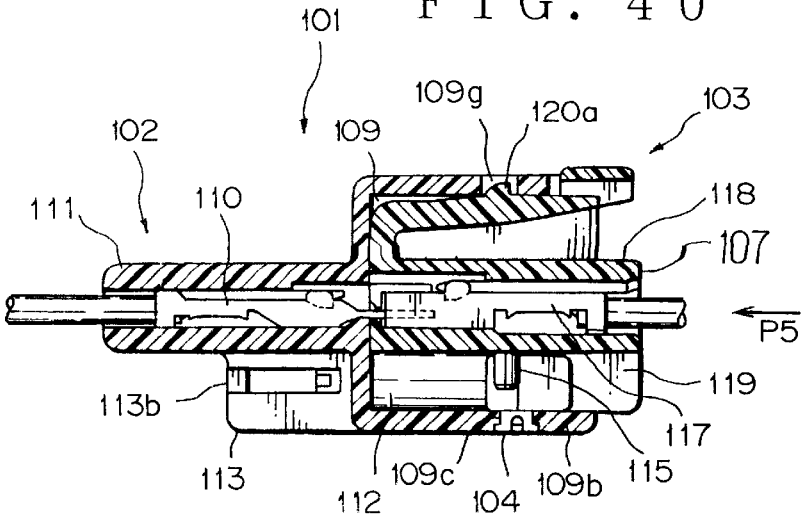
FIG. 40 is an essential portion vertical section of the connectors, shown in a full fitted condition.
Figure 41:
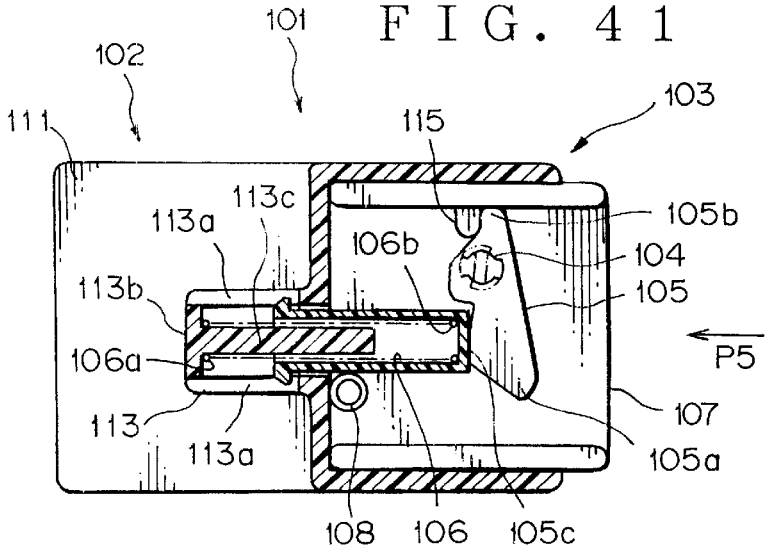
FIG. 41 is a horizontal section of the essential portions in FIG. 40.

If the male connector 103 is further pushed in the direction of the arrow P5, as shown in FIGS. 36 and 37, the drive portion 108 disengages from the driven member 105 to release the latter from the clockwise rotation, and the driven member 105, as shown in FIG. 38, is urged by the spring 106 to rotate in a counterclockwise direction. At this time, as shown in FIGS. 38 and 39, a drawing force is produced which acts through the second engagement portion 105*b* of the driven member 105 on the urged portion 115 in the direction of drawing same and thus the male connector 103. Concurrently, the male and female terminals 110 and 117 start to be connected together (FIG. 38). The male connector 103 is further pushed in the direction of the arrow P5 under the drawing force until fully coupled with the female connector 104 as shown in FIGS. 40 and 41.

The male and female connectors 102, 103 are thus coupled together with a low force, leading to an improved working efficiency.

To decouple the female and male connectors 102, 103, the above operation is effected in reverse order. More specifically, on moving the male connector 103 in the direction opposite the arrow P5 in FIG. 41, the urged portion 115 drives the driven member 105 to rotate clockwise on the drawing, compressing the spring 106. The compressed spring 106 abuts through the indirect member 112 against the cam portion 105*c* with an increased repulsion force, while at the same time generating a drawing force at the second engagement portion 105*b* side which acts on the urged portion 115 in the direction of pulling back the male connector 103.

If the male connector 103 is further moved in the direction opposite the arrow P5, as shown in FIG. 37, the urged portion 115 disengages from the driven member 105 to release the latter from the clockwise direction, and the spring 106, as shown in FIG. 35, urges the driven member 105 to rotate counterclockwise, with its first engagement portion 105*a* pushing the drive portion 108 outwardly. The male connector 103, as shown in FIG. 33, is thus detached from the female connector 102 with a low force.

Thus, as described above with reference to FIGS. 31 to 41, in the coupling operation, while the drive portion 108 is pressing on the first engagement portion 105*a* of the driven member 105, the compressed spring 106 causes a repulsion force which acts through the first engagement portion 105*a* on the drive portion 108 in the direction of repelling the male connector 103, and when the drive portion 108 disengages from the driven member 105, the spring 106 urges the driven member 105 to rotate in reverse direction so that its second engagement portion 105*b* acts on the urged portion 115 in the direction of drawing the male connector 103 into a fitted condition with the female connector 102.

Thus, with the arrangement as described above, through cooperation of the drive portion 108 and the urged portion 115 with the driven member 105, the male connector repelling force and drawing force can be produced in order, leading to a reliable coupling with a low force and an improved working efficiency.

FIGS. 42 to 47 are third conceptual views for a fourth embodiment of a connector assembly according to this invention. The fourth embodiment of this invention will be later described with reference to FIGS. 48 to 58. First, the third concept will be described with reference to FIGS. 42 to 47.

Figure 42:
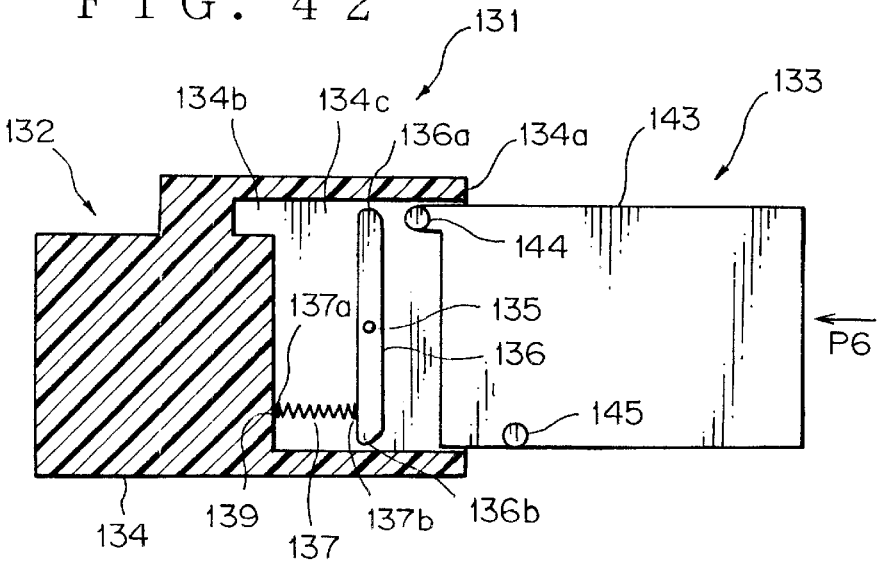
FIG. 42 is a third conceptual view for a fourth embodiment of a connector assembly according to this invention, showing in vertical section essential portions of the connectors at the start of their coupling.
Figure 43:
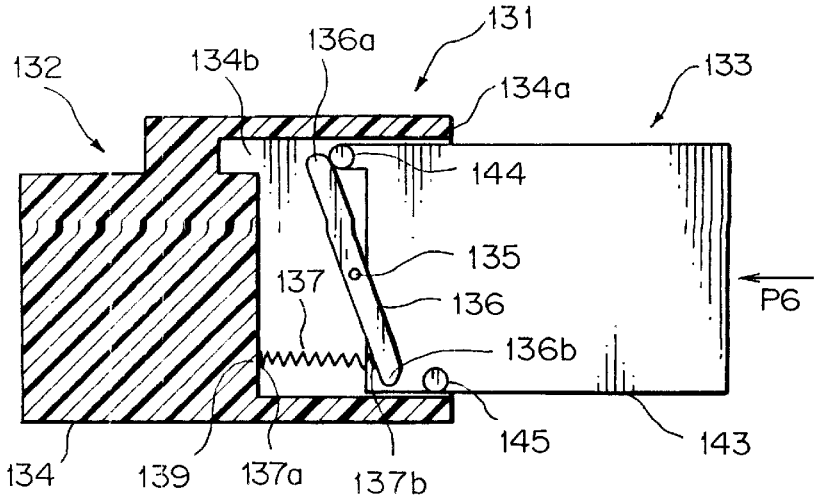
FIG. 43 is an essential portion vertical section of the connectors, shown in a halfway fitted condition proceeded from the condition of FIG. 42, where a repulsion force is acting.
Figure 44:
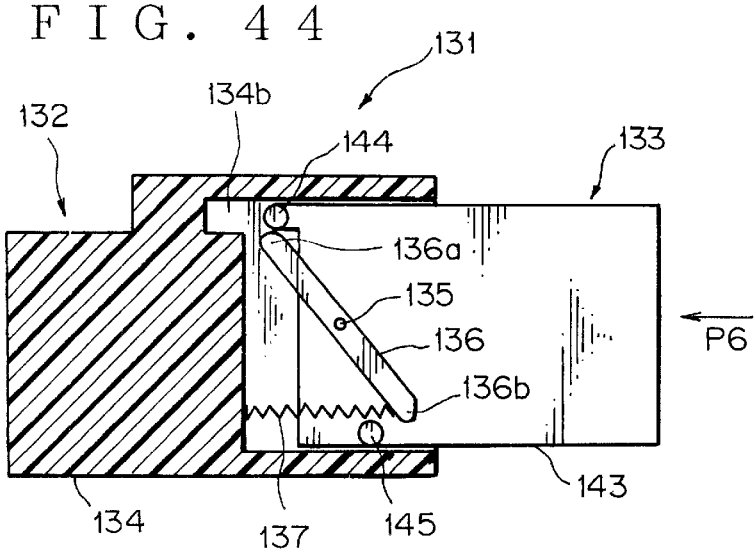
FIG. 44 is an essential portion vertical section of the connectors, shown in a condition proceeded from the condition of FIG. 43, where a drive portion is disengaged from a driven member.
Figure 45:
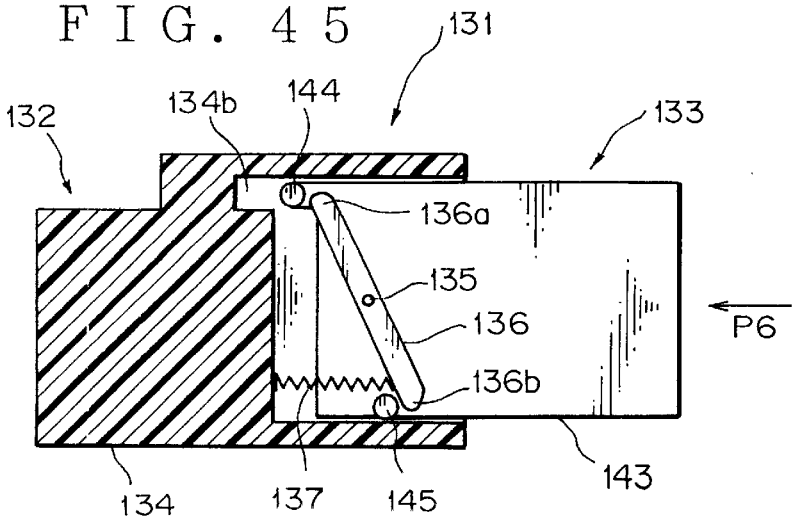
FIG. 45 is an essential portion vertical section of the connectors, shown in a condition further proceeded from the condition of FIG. 44, where a drawing force starts to act.
Figure 46:
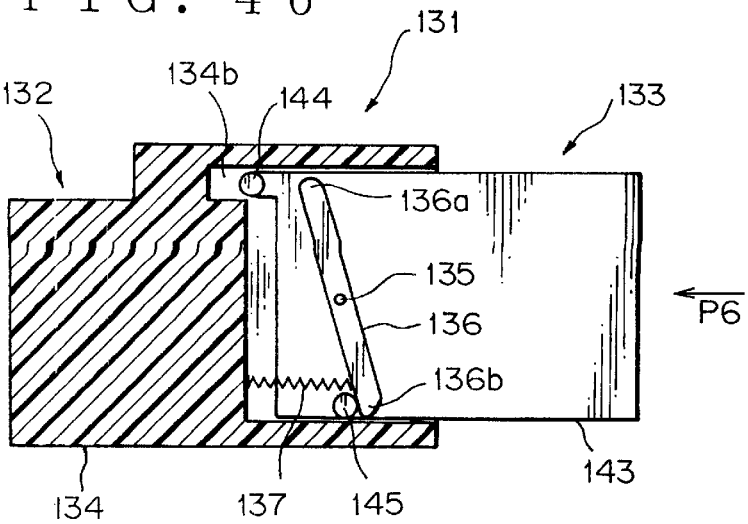
FIG. 46 is an essential portion vertical section of the connectors, shown in a condition further proceeded from the condition of FIG. 45, where the drawing force is acting.
Figure 47:
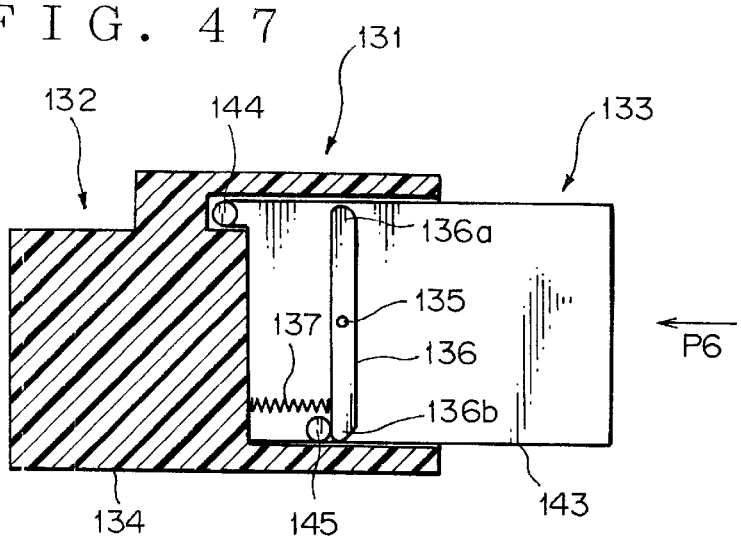
FIG. 47 is an essential portion vertical section of the connectors, shown in a full fitted condition.

FIG. 42 is a vertical section of essential portions of connectors according to this invention, FIG. 43 is an essential portion vertical section of the connectors halfway coupled and under repulsion, FIG. 44 is an essential portion vertical section of the connectors in a condition where their drive and driven member are disengaged, FIG. 45 is an essential portion vertical section of the connectors at the start of a drawing force, FIG. 46 is an essential portion vertical section of the connectors under the drawing force, and FIG. 47 is an essential portion vertical section of the connectors fully coupled.

In FIG. 42, denoted 131 is a connector assembly made up of a female connector 132 and a male connector 133 fittable to each other. For simplicity of description, male and female wired terminals of known structure, which are received in the respective female and male connectors 132, 133, and a known locking mechanism, and the like, for these connectors are omitted.

The female connector 132 includes a housing 134 of synthetic resin with a receiving section 134*b* formed therein, the receiving section 134*b* opening at the front end 134*a* of the housing 134 on a fitting side with the male connector 133, a driven member 136 rotatable about a shaft 135 provided on an inner side wall 134*c* of the housing 134, and a spring 137 provided between the housing 134 and the driven member 136, the receiving section 134*b* internally having a support 139 for the spring 137.

The driven member 136 is of rod-like shape and is rotatably supported at an intermediate portion thereof between one end 136*a* and the other end 136*b* by the shaft 135.

The spring 137, a known tension spring, is at one end 137*a* rotatably or fixedly supported on the support 139 and at the other end 137*b* rotatably or fixedly supported on the other end 136*b* of the driven member 136.

The shaft 135 is provided with not-shown rotation regulator means for restricting the rotation of the driven member 136.

The male connector 133 includes a housing 143 of synthetic resin which is received in the receiving section 134*b* of the female connector 132. The housing 143 has a projecting drive portion 144 of substantially circular cross section which, during coupling with the female connector 132, comes into contact with the one end 136*a* of the driven member 136, and a projecting urged portion 145 of substantially circular cross section at which, during coupling, the male connector 133 is urged by the other end 136*b* of the driven member 136.

The coupling operation of the above connectors 132 and 133 will now be described with reference to FIGS. 42 to 47.

The female connector 132 and the male connector 133 are arranged in opposed relation to be coupled as shown in FIG. 42, followed by moving the male connector 133 in the direction of an arrow P6 to start the coupling.

As the male connector 133 advances into the female connector 132, the male connector drive portion 144 comes into contact with the driven member 136 to rotate same counterclockwise on the drawing, stretching the spring 137. At this time, the stretched spring 137, due to its restoring nature, pulls at the other end 136*b* of the driven member 136, producing a repulsion force at the one end 136*a* side of the driven member 136 which acts on the drive portion 144 in a direction which tends to repel and push out the male connector 133, with the result that an incomplete coupling can be prevented.

If the male connector 133 is further pushed in the direction of the arrow P6, the drive portion 144, as shown in FIG. 44, disengages from the driven member 136 to release the driven member from its counterclockwise rotation, and the spring 137 urges the driven member 136 in a clockwise direction as shown in FIG. 45. Concurrently with the above, a drawing force is generated at the other end 136*b* side of the driven member 136 which acts on the urged portion 145 in the direction of drawing the male connector 133. In other words, as shown in FIG. 46, the other end 136*b* of the driven member 136 abuts against and presses on the urged rod 145 to push the latter and thus the male connector 133 deeper into the female connector 132. The male connector 133 is thus pushed in the direction of the arrow P6 under the drawing force into a full fitted position with the female connector 132 as shown in FIG. 47.

A reduction is thus made in the force required for the fitting operation and a so-called low coupling force connector assembly is attained, leading to an improved working efficiency.

To decouple the female and male connectors 132, 133, the above operation is effected in reverse order. More specifically, on moving the male connector 133 in the direction opposite the arrow P6 in FIG. 47, the urged portion 145 presses on the other end 136*b* of the driven member 136 and rotates the driven member 136 counterclockwise on the drawing. The spring 137 is concurrently stretched and, due to its restoring nature, pulls at the other end 136*b* of the driven member 136.

As the male connector 133 is further moved in the direction opposite the arrow P6, the urged portion 145, as shown in FIG. 44, disengages from the driven member 136 to release the driven member 136 from the counterclockwise rotation, and the spring 137 urges the driven member 136 to rotate in the clockwise rotation as shown in FIG. 43, at which time the driven member 136 at the one end 136*a* comes into contact with the drive portion 144. The repulsion force produced at the one end 136*a* side of the driven member 136 acts on the drive rod 144 in the direction of pushing out the drive portion and thus the male connector 133. Consequently, as shown in FIG. 42, the male and female connectors 133 and 132 can be decoupled with a low force.

Thus, as described above with reference to FIGS. 42 to 47, in the fitting operation, while the drive portion 144 is pressing on the one end 136*a* of the driven member 136, the stretched spring 137, due to its restoring nature, causes a repulsion force at the one end 136*a* side of the driven member 136 which acts on the drive portion 144 in the direction of repelling the male connector 133, and when the drive portion 144 disengages from the driven member 136, the spring 137 urges the driven member 136 to rotate in reverse direction so that its other end 136*b* abuts against and acts on the urged portion 145 in the direction of pushing the male connector 133 into a fitted condition with the female connector 132.

Thus, with the arrangement as described above, through cooperation of the drive portion 144 and the urged portion 145 with the driven member 136, the male connector repelling force and drawing force can be produced in order, leading to a reliable coupling with a low force and an improved working efficiency.

A fourth embodiment of a connector assembly according to this invention will now be described with reference to FIGS. 48 to 58.

Figure 49:
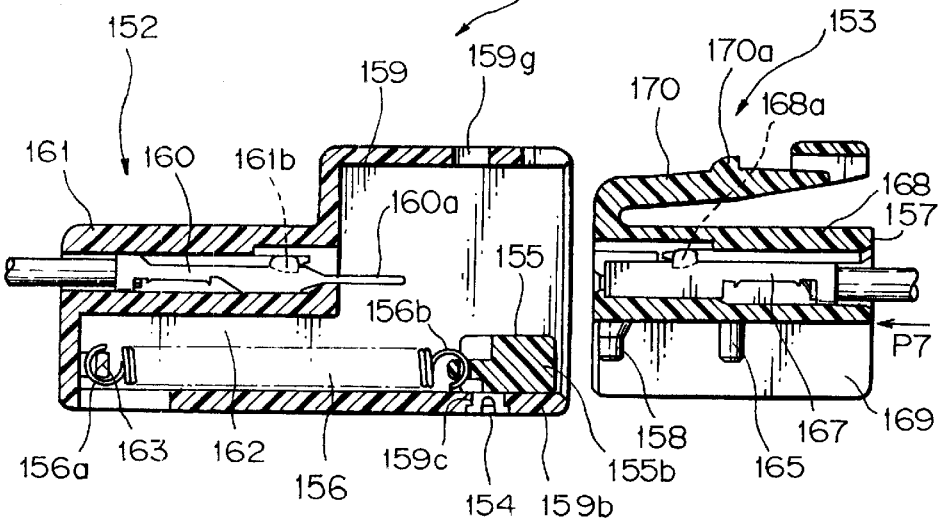
FIG. 49 is an essential portion vertical section of the connectors of FIG. 48.
Figure 50:
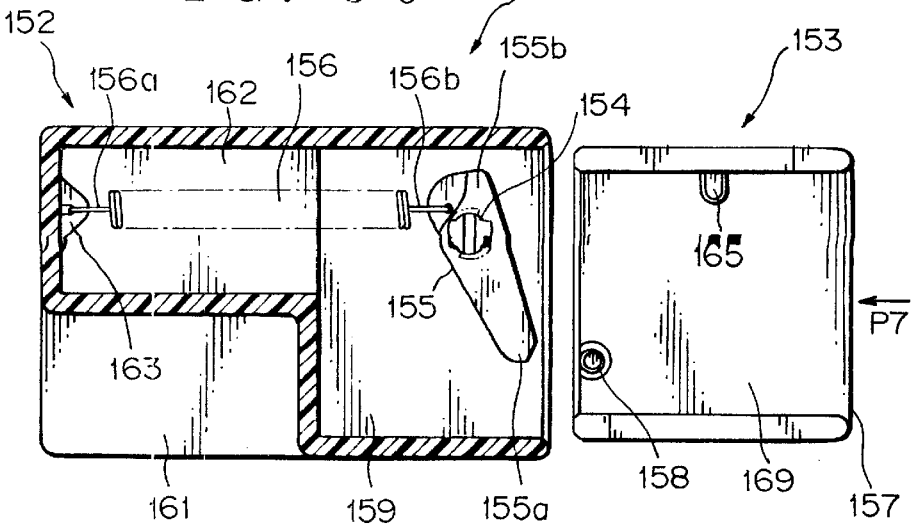
FIG. 50 is a horizontal section of the essential portions in FIG. 49.
Figure 48:
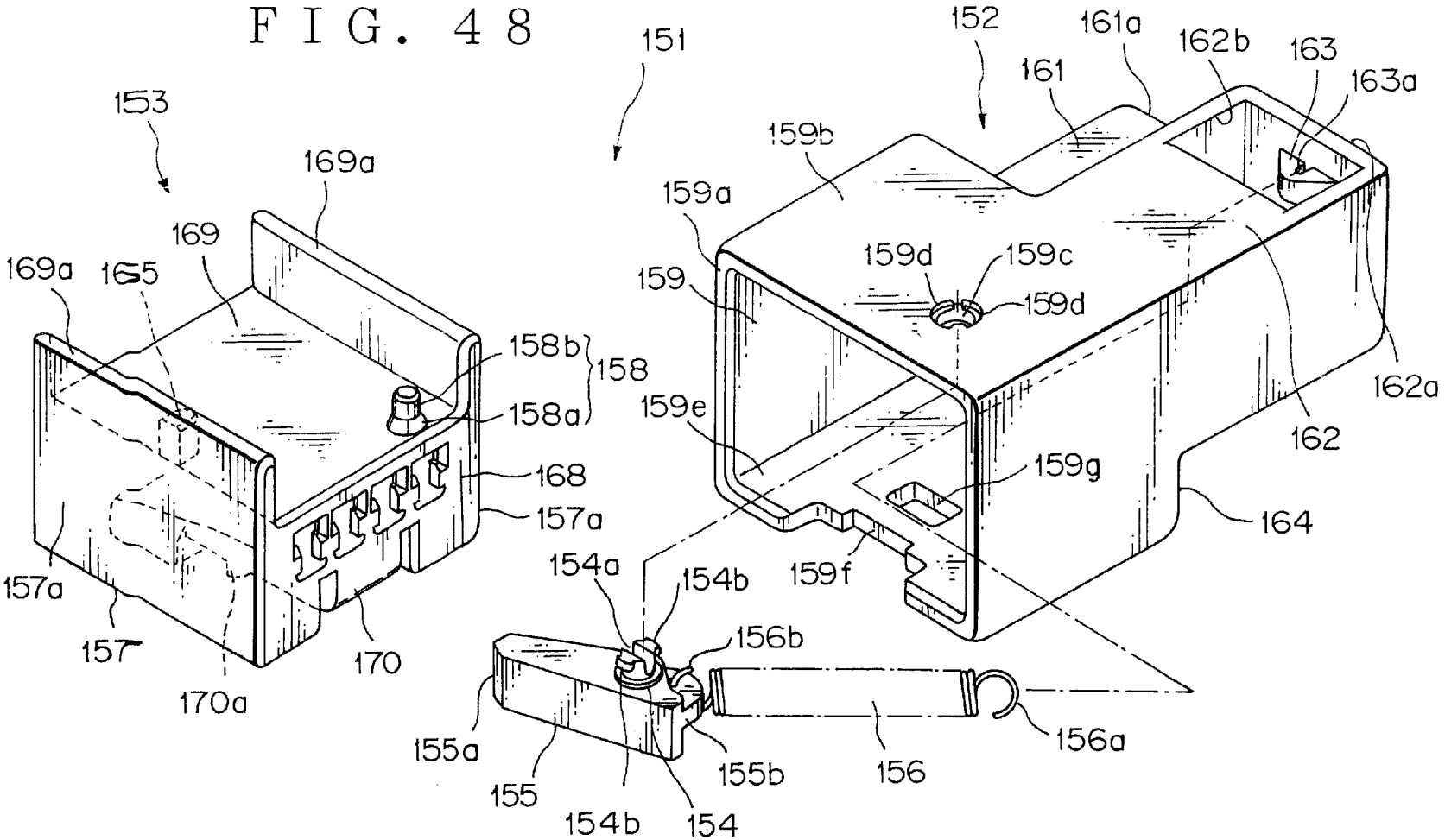
FIG. 48 is an exploded perspective view of a fourth embodiment of a connector assembly according to this invention.

FIG. 48 is an exploded perspective view of the connector assembly according to the fourth embodiment, with the connector assembly shown upside down for convenience of explanation, FIG. 49 is an essential portion vertical section of the connector assembly of FIG. 48, and FIG. 50 is an essential portion horizontal section of the connector assembly of FIG. 49.

In FIG. 48, denoted 151 is a connector assembly which is made up of a female connector 152 and a male connector 153 fittable to each other. The female connector 152 is provided with a driven member 155 with a shaft 154 and a tension spring 156. The male connector 153 has a drive portion 158 and an urged portion 165, both formed on its housing 157.

The female connector 152 includes a rectangular receiving section 159 which opens at the front end 159*a* for receiving the housing 157 of the male connector 153, and a terminal accommodating section 161 with a row of known male terminals 160 accommodated therein (only one is shown in FIG. 49), the terminal accommodating section 151 adjoining the receiving section 159 at the rear end.

The female connector 152 internally has an empty space 162 in communication with the receiving section 159, which empty space is defined below the terminal accommodating section 161 (FIG. 49), and a triangular-shaped support 163 provided integrally on an inner rear wall 162*a* of the empty space 162.

A shaft hole 159*c* for the shaft 154 is provided in one wall 159*b* of the receiving section 159, the shaft hole having a pair of recesses 159*d*, 159*d* formed at its circumferential edge which cooperate with a later-described pair of rotation regulating projections 154*b*, 154*b* of the shaft 154 to restrict the rotation of the driven member 155. The wall 159*e* opposed to the one wall 159*b* has a recess 159*f* extending inwardly from the front end 159*a* in a stepped manner and a rectangular locking hole 159*g* formed therethrough on an inboard side of the stepped recess 159*f*.

The support 163 is provided with a throughhole 163*a* to which the spring 156 is at one end 156*a* anchored. Denoted 162*b* is a work window for use in mounting the spring 156.

The driven member 155, which is constituted by a cam-like plate of synthetic resin, has a first engagement portion 155*a* for the drive portion 158, a second engagement portion 155*b* for the urged portion 165, and the shaft 154 which is fitted into the shaft hole 159*c* to rotatably support the driven member 155 inside the receiving section 159. The spring 156 is at the other end 156*b* rotatably coupled to the second engagement portion 155*b* of the driven portion 155.

The shaft 154 is substantially of circular cross section and has a vertical slit 154*a* extending from the top end toward the driven member 155. The pair of rotation regulating projections 154*b*, 154*b* are provided on opposite sides of the slit at the top end of the shaft 154.

The male connector 153 includes a rectangular housing 157 with a rectangular-shaped terminal accommodating section 168 formed therein for receiving a row of known female terminals 167 (only one is shown in FIG. 49). The housing 157 has a drive portion-containing space section 169 formed at one vertical side of the terminal accommodating section 168, the drive portion-containing space section containing the drive portion 158 and the urged portion 165. At the other vertical side of the terminal accommodating section 168 is provided a locking arm 170.

The drive portion-containing section 169 is laterally defined by side walls 169*a*, 169*a* of the housing 157, and the drive portion 158 and the urged portion 165 are located therein at such positions as will come into contact with the first engagement portion 155*a* and the second engagement portion 155*b* of the driven member 155, respectively, when fitting the connectors 152, 153.

The drive portion 158 consists of a ring-shaped seat 158*a* and a pin 158*b* of substantially circular cross section erected on the seat 158*a*. The urged portion 165 is a pin member located adjoining the side wall 169*a* and having a U-shaped cross section.

The locking arm 170 is of known structure and is provided with a locking projection 170*a* for locking engagement in the locking hole 159*g*.

The assemblage of the female and male connectors 152 and 153 will now be described with reference to FIGS. 49 and 50.

First, description is made of the female connector 152.

As shown in FIG. 49, the terminal receiving section 161 has wired male terminals 160 locked therein with related lances 161*b*. The electrical contact 160*a* of the male terminal 160 is located protruding into the receiving section 159.

The driven member 155 is mounted on the inner side of the one wall 159*b* of the receiving section 159, with its shaft 154 fitted in the shaft hole 159*c*. The spring 156 having one end 156*a* supported on the support 163 is at the other end 156*b* coupled to the second engagement portion 155*b* of the driven member 155. The spring 156 is normally stretched to some extent to pull the driven member 155.

The shaft 154 and the support 163, as indicated in FIG. 50, are offset from the axis (not shown) of the female connector 152. The driven member 155 has its first engagement portion 155*a* located on a side closer to the male connector 153.

Description will now be made of the male connector 153.

As shown in FIG. 49, the terminal accommodating section 168 has wired female terminals 167 locked therein with related lances 168*a*.

The drive portion 158 and the urged portion 165*d* are located on opposite sides of the not-shown axis of the male connector 153 such that, as described above, the drive portion 158 comes into abutment against the first engagement portion 155*a* of the driven member 155 and the urged portion 165 comes into abutment against the second engagement portion 155*b*.

The coupling operation of the female and male connectors 152 and 153 will now be described with reference to FIGS. 49 to 58, each two of which, for example, FIGS. 49 and 50, FIGS. 51 and 52, . . . are paired, odd figures being longitudinal sections and even figures being horizontal sections showing essential portions of the related odd figures.

The female connector 152 and the male connector 153 are arranged in opposed relation to be coupled, as shown in FIGS. 49 and 50, followed by moving the male connector 153 in the direction of an arrow P7 to start the coupling.

As the male connector 153 advances into the female connector 152, the male connector drive rod 158 comes into contact with the first engagement portion 155*a* of the driven member 155 to rotate the driven member clockwise on the drawing, stretching the spring 156. At this time, the male and female terminals 160 and 167 are still not in contact with each other (FIG. 51).

The stretched spring 156 pulls at the second engagement portion 155*b* of the driven member 155, producing a repulsion force at the first engagement portion 155*a* side of the driven member 155 which acts on the drive rod 158 in the direction of repelling the male connector 153. Thus, in a halfway fitted condition as shown in FIGS. 51 and 52, the male connector 153 is pushed out, thereby to prevent an incomplete fitting of the connectors 152, 153.

Figure 54:
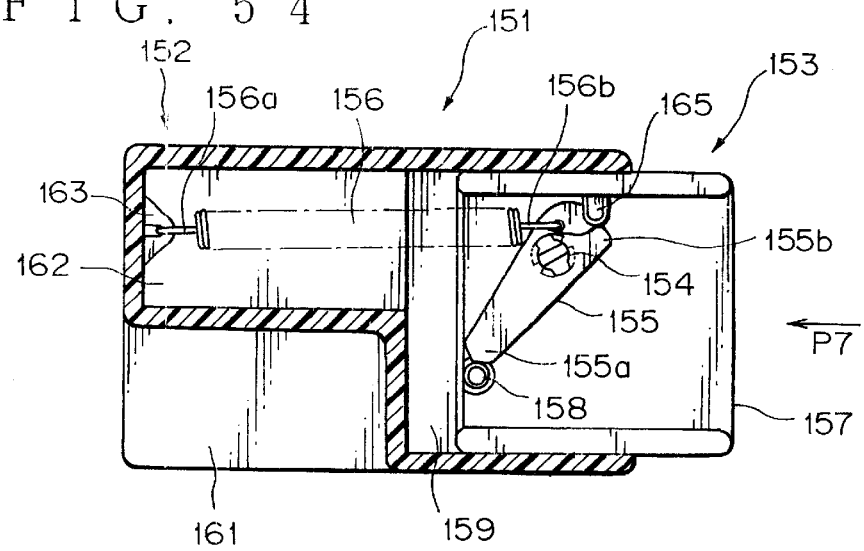
FIG. 54 is a horizontal section of the essential portions in FIG. 53.
Figure 55:
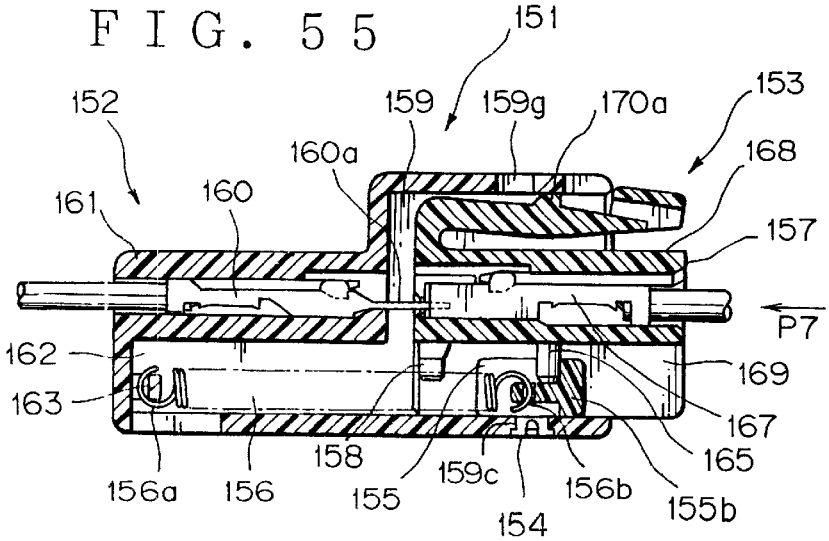
FIG. 55 is an essential portion vertical section of the connectors, shown in a condition further proceeded from the condition of FIG. 53.
Figure 56:
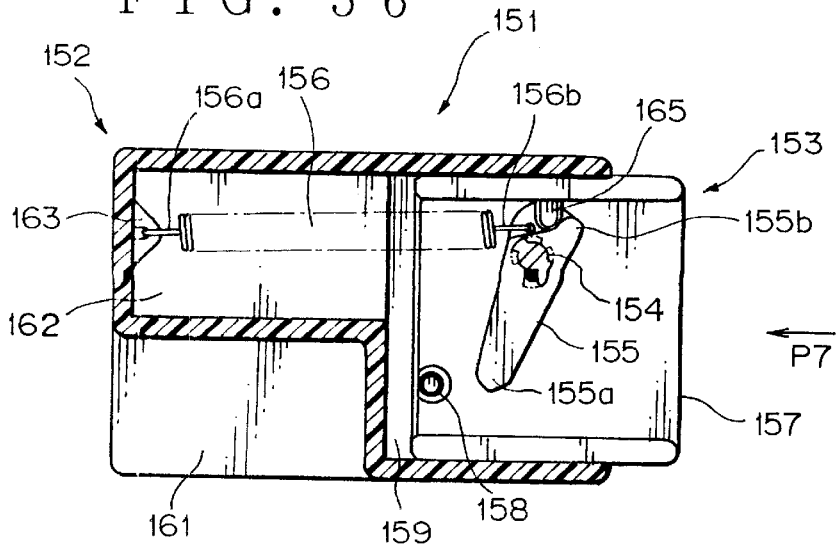
FIG. 56 is a horizontal section of the essential portions in FIG. 55.
Figure 57:
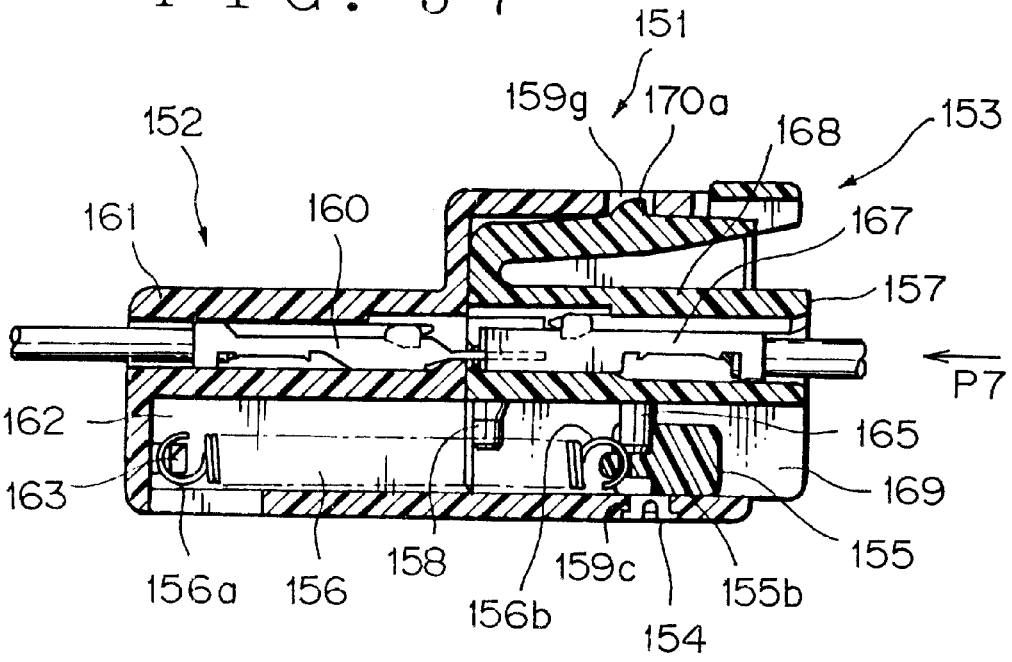
FIG. 57 is an essential portion vertical section of the connectors, shown in a full fitted condition.
Figure 58:
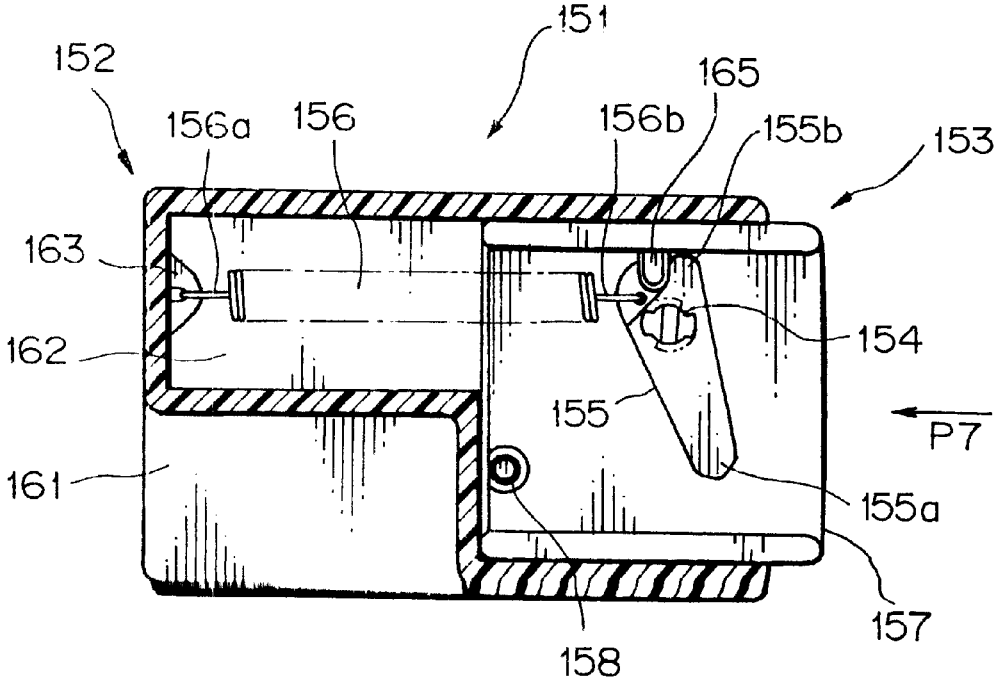
FIG. 58 is a horizontal section of the essential portions in FIG. 57.

If the male connector 153 is further pushed in the direction of the arrow P7, the drive portion 158, as shown in FIGS. 53 and 54, disengages from the driven member 155 to release the latter from the counterclockwise rotation, and the spring 156 urges the driven member 155 to rotate in a counterclockwise direction as shown in FIG. 56. At this time, as shown in FIGS. 55 and 56, a drawing force is produced which acts through the second engagement portion 155*b* of the driven member 155 on the urged portion 155 in the direction of drawing same and thus the male connector 153. Concurrently, the male and female terminals 160 and 167 start to be connected together (FIG. 55). The male connector 153 is thus pushed in the direction of the arrow P7 under the drawing force into a full coupled position with the female connector 152 as shown in FIGS. 57 and 58.

A reduction is thus made in the force required for the coupling operation and a so-called low coupling force connector assembly is attained, leading to an improved working efficiency.

To decouple the female and male connectors 152, 153, the above operation is effected in reverse order. More specifically, on moving the male connector 153 in the direction opposite the arrow P7 in FIG. 58, the urged portion 165 drives the driven member 155 to rotate clockwise on the drawing, stretching the spring 156. The stretched spring 156, due to its restoring nature, pulls at the second engagement portion 155*b* of the driven member 155, generating a drawing force which acts on the urged portion 165 in the direction of pulling back the male connector 153.

If the male connector 153 is further moved in the direction opposite the arrow P7, the urged rod 155, as shown in FIG. 54, disengages from the driven member 155 to release the latter from the clockwise rotation, and the spring 156, as shown in FIG. 52, urges the driven member 155 to rotate counterclockwise, with its first engagement portion 155*a* pushing the drive portion 158 outwardly. The male connector 153, as shown in FIG. 50, is thus detached from the female connector 152 with a low force.

Thus, as described above with reference to FIGS. 48 to 58, in the fitting operation, while the drive portion 158 is pressing on the first engagement portion 155*a* of the driven member 155, the stretched spring 156, due to its restoring nature, causes a repulsion force at the first engagement portion 155*a* of the driven member 155 which acts on the drive portion 158 in the direction of repelling the male connector 153, and when the drive portion 158 disengages from the driven member 155, the spring 156 urges the driven member 155 to rotate in reverse direction so that its second engagement portion 155*b* abuts against and acts on the urged portion 165 in the direction of pushing the male connector 153 into a fitted condition with the female connector 152.

Thus, with the arrangement as described above, through cooperation of the drive portion 158 and the urged portion 165 with the driven member 155, the male connector repelling force and drawing force can be produced in order, leading to a reliable coupling with a low force and an improved working efficiency.

Having now fully described the invention, it will be apparent to one of ordinary skill in the art that many changes and modifications can be made thereto without departing from the spirit and scope of the invention as set forth herein.

What is claimed is:

1. An electrical connector assembly comprising:

a first connector including a driven member rotatably supported thereon and a resilient member provided between said first connector and said driven member; and a second connector including a drive means which, during fitting said first and second connectors, engages with, and drives, said driven member into rotation to bias said resilient member, said driven member having an elongated slit with closed ends defining a slide guide, and said resilient member being at a first end of said slit supported on said first connector and at a second end engaged with said slide guide to be slidable between opposite ends of said slide guide to cause a switch from a repulsion force to a drawing force, and wherein said resilient member, when biased, produces consecutively said repulsion force and said drawing force on said driven member, said repulsion force and said drawing force acting through said driven member on said second connector alternatively in opposite directions for alternately repelling and drawing said second connector with respect to said first connector.

2. The electrical connector assembly according to claim 1, wherein said slide guide comprises a straight slide slit.

3. The electrical connector assembly according to claim 1, wherein said slide guide comprises a slide slit bent at an intermediate portion thereof into two straight portions, both inclined toward a side opposite said second connector.

4. The electrical connector assembly according to claim 1, wherein said driven member has a cutout for sliding engagement therein of said drive means, and said repulsion force and said drawing force, when said drive means is engaged in said cutout, act through said driven member on said drive means and thus on said second connector.

5. The electrical connector assembly according to claim 1 wherein said resilient member comprises a tension spring.

6. The electrical connector assembly according to claim 1, wherein said second connector further includes an urged means, and wherein said drive means and said urged means, during fitting said first and second connectors, come into engagement in order with a first and a second ends of said driven member, respectively, and during when said drive means engages with said first end of said driven member, said driven member is rotated in a direction to bias said resilient member and produce said repulsion force which acts through said first end of said driven member on said drive means in said direction of repelling said second connector, and when said drive means disengages from said first end of said driven member, said driven member is rotated in reverse direction by a resilient force of said resilient member to produce said drawing force and said urged means engages with said second end of said driven member such that said drawing force acts on said urged means in said direction of drawing said second connector.

7. The electrical connector assembly according to claim 6, wherein said drive means and said urged means are disposed on opposite sides of an axis of said second connector, said drive means being at a position closer to said first connector than said urged means.

8. The electrical connector assembly according to claim 6, wherein said resilient member is a compression spring and disposed between said first connector and said driven member at said first end side where said drive means engages.

9. The electrical connector assembly according to claim 8, wherein said compression spring is at an end thereof directly supported on said driven member at said first end side.

10. The electrical connector assembly according to claim 8, wherein said compression spring is at one end supported through a support on said first connector and at the other end operably engageable with said driven member at said first end side through a closed-end indirect member fitted over said compression spring, said indirect member being longitudinally slidable in said support.

11. The electrical connector assembly according to claim 10, wherein said compression spring is internally supported by a collapse-preventing pin-like element around which said compression spring is retained.

12. The electrical connector assembly according to claim 6, wherein said resilient member is a tension spring and disposed between said first connector and said driven member at said second end side where said urged means engages.

13. The electrical connector assembly according to claim 1, wherein said driven member is rotatable about a shaft provided on said first connector, which shaft is provided with a rotation regulating means for restricting a rotational position of said driven member at least prior to fitting said first and second connectors.

14. The electrical connector assembly according to claim 1, wherein said first and second connectors, after completion of coupling, are decoupleable in reversed order with said drawing force first acting through said driven member on said second connector and said repulsion force then acting through said driven member on said second connector during detaching said first and second connectors.

* * * * *